US007198532B2

(12) United States Patent
Field

(10) Patent No.: US 7,198,532 B2
(45) Date of Patent: Apr. 3, 2007

(54) FIN ATTACHMENT SYSTEM

(76) Inventor: John Field, GPO Box 5695, Hong Kong (HK)

( * ) Notice: Subject to any disclaimer, the term of this patent is extended or adjusted under 35 U.S.C. 154(b) by 0 days.

(21) Appl. No.: 11/300,642

(22) Filed: Dec. 13, 2005

(65) Prior Publication Data

US 2006/0258239 A1 Nov. 16, 2006

Related U.S. Application Data

(60) Provisional application No. 60/654,338, filed on Feb. 18, 2005.

(30) Foreign Application Priority Data

Dec. 13, 2004 (AU) ..... 2004907054
Dec. 14, 2004 (AU) ..... 200407120
Feb. 8, 2005 (AU) ..... 2005100116

(51) Int. Cl.
*B63B 1/00* (2006.01)
*B63B 35/00* (2006.01)

(52) U.S. Cl. ..... 441/79; 114/127; 114/140

(58) Field of Classification Search ..... 441/74, 441/79

See application file for complete search history.

(56) References Cited

U.S. PATENT DOCUMENTS 5,464,359 A * 11/1995 Whitty ..... 441/79
5,672,081 A * 9/1997 Whitty ..... 441/79
5,830,025 A 11/1998 Fleming
6,139,383 A * 10/2000 Jolly et al. ..... 441/74
6,752,674 B2 * 6/2004 Jolly ..... 441/79
6,793,548 B2 * 9/2004 Jolly et al. ..... 441/79
6,991,503 B2 * 1/2006 Garcia ..... 441/79
6,991,504 B1 * 1/2006 English et al. ..... 441/79
7,001,236 B2 * 2/2006 Blake, Jr. ..... 441/79
2003/0092333 A1 5/2003 McCausland et al.
2003/0124924 A1 7/2003 McCausland et al.
2006/0019559 A1 1/2006 Mair et al.
2006/0178061 A1 8/2006 Caldwell

FOREIGN PATENT DOCUMENTS

AU 199334088 A1 9/1993
AU 199521660 A1 11/1995
DE 40 38 517 A1 6/1991
EP 0 834 451 A2 4/1998

(Continued)

OTHER PUBLICATIONS

International Search Report mailed Aug. 11, 2006.

(Continued)

*Primary Examiner*—Lars A. Olson
(74) *Attorney, Agent, or Firm*—Nixon & Vanderhye P.C.

(57) ABSTRACT

A fin box for releasable attachment of a fin to the body of a surfboard or the like; said fin including a fin-tab associated therewith; said fin box adapted for insertion into and retention within said surfboard; said fin box further adapted for reception and releasable retention of a plurality of fin-tab configurations thereby to releasably retain said fin in fixed relationship to said surfboard; and wherein a first surface of said fin box is of a length and a width sufficient to support said fin entirely so that no portion of said fin is in contact with the body of said surfboard or the like.

76 Claims, 22 Drawing Sheets

FOREIGN PATENT DOCUMENTS

| | | |
|---|---|---|
| WO | 00/32466 | 6/2000 |
| WO | 01/70565 | 9/2001 |
| WO | 03/018395 | 3/2003 |
| WO | 03/095301 | 11/2003 |
| WO | 2004/035377 | 4/2004 |
| WO | 2006/021029 | 3/2006 |

OTHER PUBLICATIONS

Written Opinion mailed Aug. 11, 2006.
Notification of International Search Report and The Written Opinion mailed Aug. 11, 2006.

* cited by examiner

FIN ATTACHMENT SYSTEM

RELATED APPLICATION

This application claims the benefit of U.S. Provisional Application No. 60/654,338, filed Feb. 18, 2005, and also claims priority to Australian Provisional Application No. 2004907054, filed Dec. 13, 2004, Australian Provisional Application No. 200407120, filed Dec. 14, 2004, and Australian Innovation Application No. 2005100116, filed Feb. 8, 2005 which are hereby incorporated in their entirety by reference herein

BACKGROUND

The present invention relates to fins and their attachment to small water craft and, more particularly to a system for attaching a variety of fin configurations to a surfboard.

As with many types of sporting equipment, many variations on the basic article have been developed to tailor the article to the preferences of the user and the conditions of use. So it is with the fins attached to the rear undersides of surfboards.

It is an obvious advantage for the owner of a board to be able to interchange the fin or fins both to experiment, with the aim of finding the fin most suited to their body weight and style of riding, and from time to time to suit the conditions in which the board is to be ridden.

Interchangeable fin systems are known and comprise of a selection of fins retained in a so-called fin box. Particular examples may be found in U.S. Pat. No. 5,830,025, U.S. Pat. No. 5,975,974 and WO 01/70565. The fin box is generally a permanent fixture built into the body of the board during its manufacture and, again generally includes a slot or slots into which the tab or heel of the fin may be inserted. The means for retaining an inserted fin securely in the fin box are many and varied, ranging from relatively simple snap-in systems to arrangements incorporating fasteners requiring the application of tools to install and remove a fin from its fin box.

A disadvantage with these systems is that the fin box is designed to take only one configuration of a fin tab, so that the owner of a board who wishes to change or experiment with a variety of fins from manufacturers other than the manufacturer of his or her board, or at least the fin boxes fitted to the board, is restricted in choice.

It is an object of the present invention to address or at least ameliorate some of the above disadvantages.

BRIEF DESCRIPTION OF INVENTION

In one aspect, the invention is structure for releasable attachment of a fin to the body of a surfboard or the like; said fin including a fin-tab associated therewith; said structure adapted for insertion into and retention within said surfboard; said structure further adapted for reception and releasable retention of a plurality of fin-tab configurations thereby to releasably retain said fin in fixed relationship to said surfboard.

In another aspect, the invention is a method for releasable attachment of a plurality of fin-tab configurations of at least one fin of a surfboard; said method including the steps of:

(a) providing at least a centre fin box embedded in said surfboard; said fin box comprising an elongate body with a recess, (b) withdrawing set-screws provided in angled threaded holes in said fin box sufficient to allow insertion of said fin-tab into said recess, (c) driving said set-screws into contact with said fin-tab.

In another aspect, the invention is a fin box for releasable attachment of a fin to the body of a surfboard or the like; said fin including a fin-tab associated therewith; said fin box adapted for insertion into and retention within said surfboard; said fin box further adapted for reception and releasable retention of a plurality of fin-tab configurations thereby to releasably retain said fin in fixed relationship to said surfboard; and wherein a first surface of said fin box is of a length and a width sufficient to support said fin entirely so that no portion of said fin is in contact with the body of said surfboard or the like.

In another aspect, the invention is a fin retention system adapted to be positioned within a water craft, the system comprising:

a body that defines an opening wherein the opening is sized so as to receive a plurality of different types of fins, each of the plurality of different type of fins having fin tabs having different configurations wherein the body is adapted to be mounted through an outer surface of the water craft;

a flange that surrounds the opening in the body so as to extend outward therefrom wherein the flange is positioned generally flush with the outer surface of the water craft when the body is positioned within the water craft;

a first retention mechanism positioned within the body that engages with a first configuration of fin tabs; and a second retention mechanism positioned within the body that engages with a second configuration of fin tabs.

BRIEF DESCRIPTION OF DRAWINGS

Embodiments of the present invention will now be described with reference to the accompanying drawings wherein.

DETAILED DESCRIPTION OF PREFERRED EMBODIMENTS

First Preferred Embodiment

Figure 1:
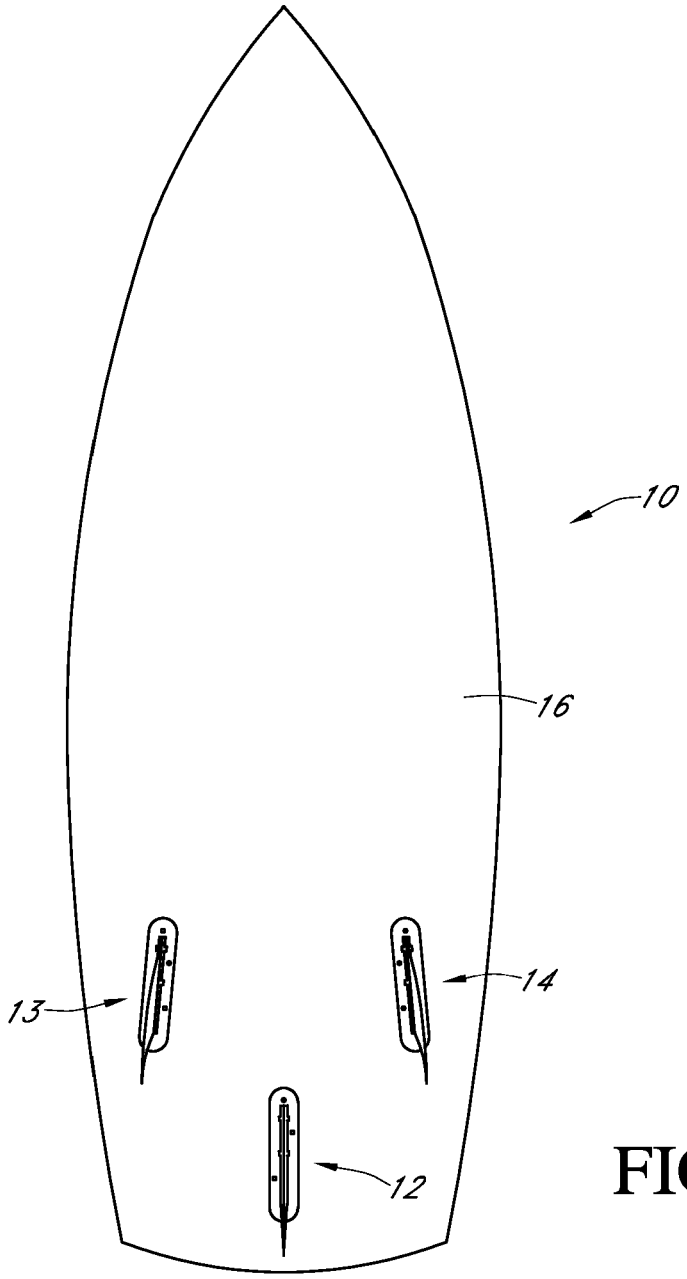
FIG. 1 is a view of the underside of a surfboard fitted with the fin attachment system for a typical three-fin arrangement according to a preferred embodiment of the invention.
Figure 2:
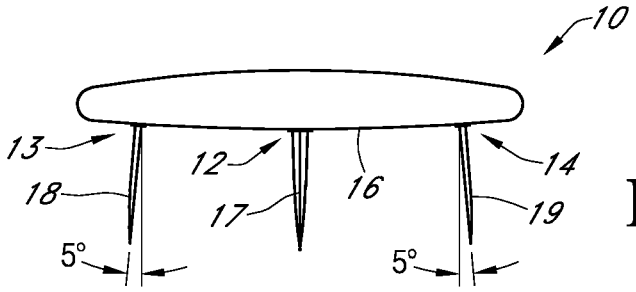
FIG. 2 is an end view of the surfboard of FIG. 1 showing a centre and left and right fins.

In a first preferred embodiment of the invention and with reference to FIGS. 1 and 2, a surfboard 10 is fitted with three fin retaining structures 12, 13 and 14, commonly known as fin boxes, embedded into the underside 16 of surfboard 10. Fin box 12 provides for a centre fin 17, while fin boxes 13 and 14 accommodate left outside fin 18 and right outside fin 19 respectively.

Figures 3A, 3B, 3C, 3D:
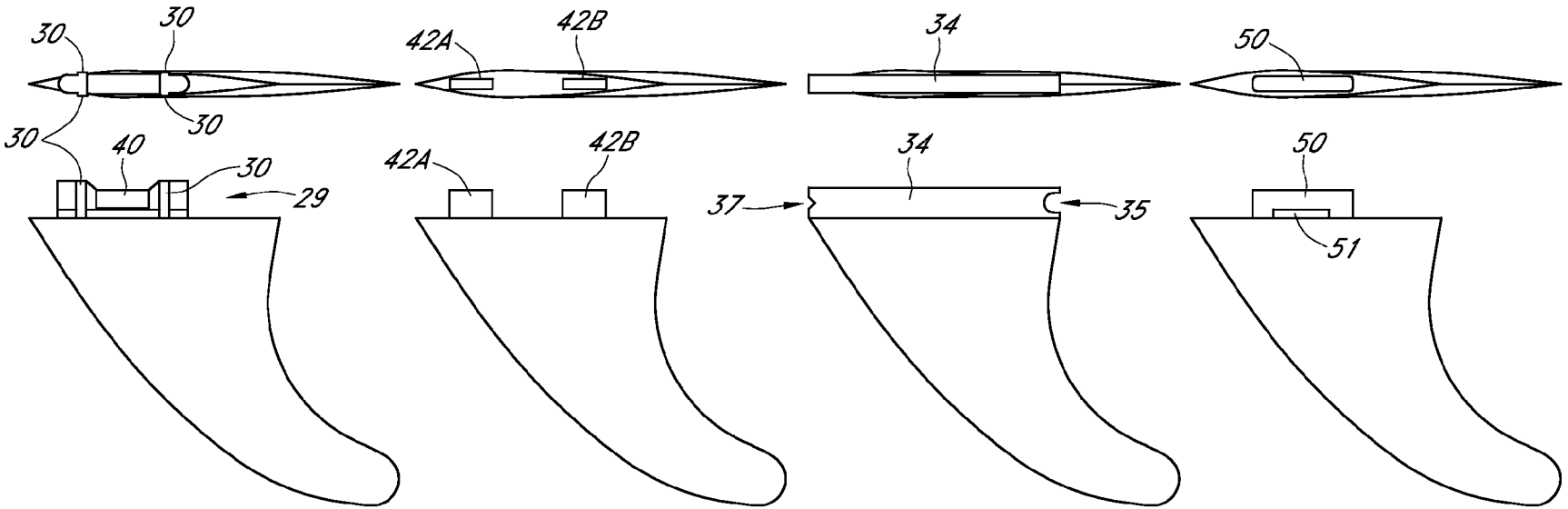
FIG. 3 shows side views and plan views of four fin and fin-tab configurations able to be fitted to a preferred embodiment of the fin attachment system, or fin box of the present invention.

Fins 17, 18 and 19 are held in retaining structures of fin boxes 12, 13 and 14 by a fin-tab formed at the top edge of the fin, that is that edge of the fin substantially flush with the surface of the underside of the surfboard. Examples of typical fins and fin-tabs commercially available are shown in FIG. 3.

Referring again to FIG. 2, it will be noted that while centre fin 17 has its central plane normal to the underside 16 of surfboard 10, the left and right outside fins are canted outwardly relative to that plane. That canting is generally at an angle of 5 degrees. Canting of outside fins may be introduced either by introducing the cant angle within the recess of the left and right fin boxes, or by the canting of the plane of the fin relative to the fin-tab. The fin boxes 13 and 14 of the present invention provide for canting of outside fins which have the fin-tab in-line (that is, no canting of the fin-tab), as well as allowing the use of outside fins canted relative to the fin-tab, as will be explained in more detail below.

Figure 4:
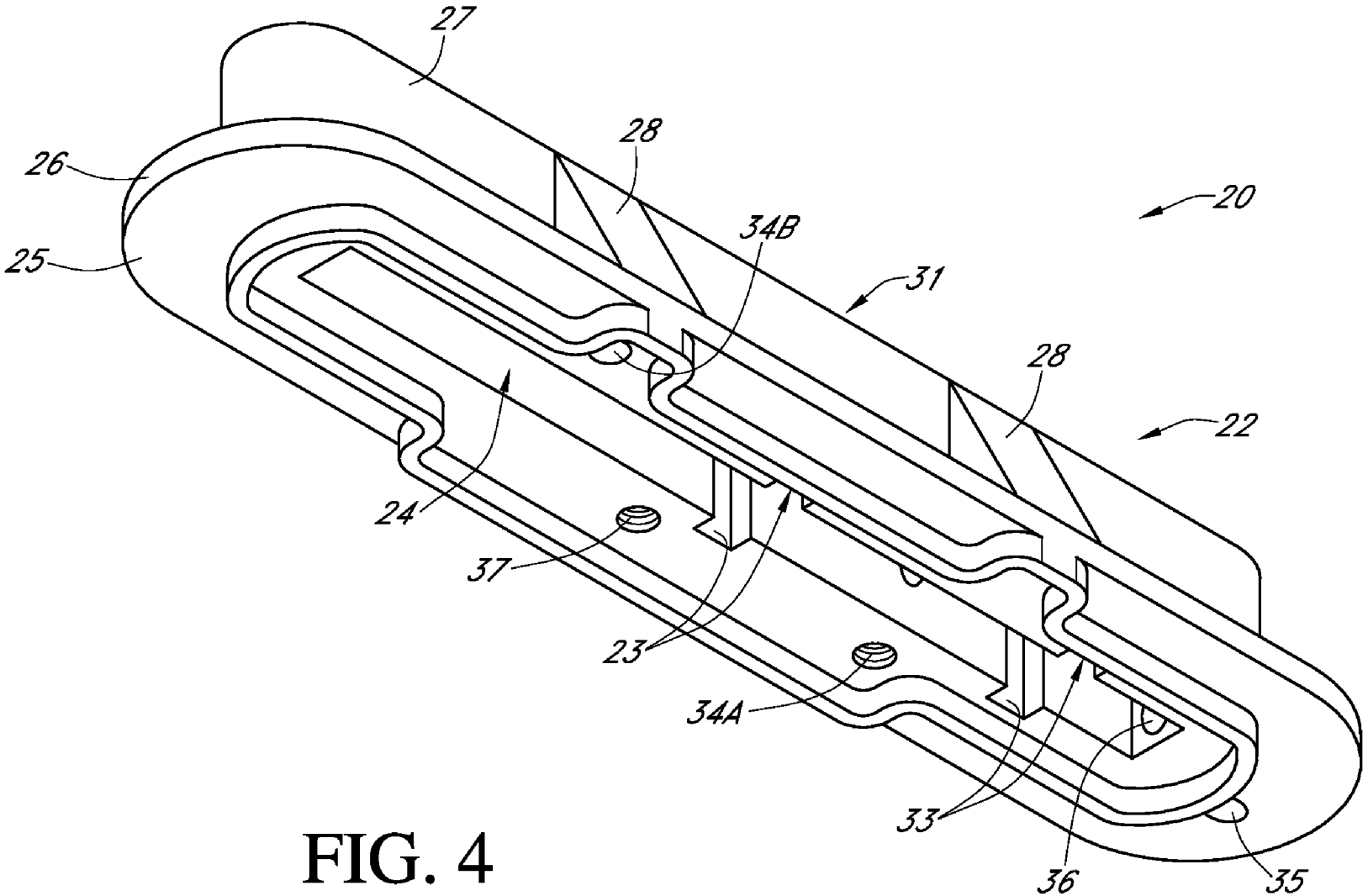
FIG. 4 is a perspective view from below of a centre fin-box.
Figure 5:
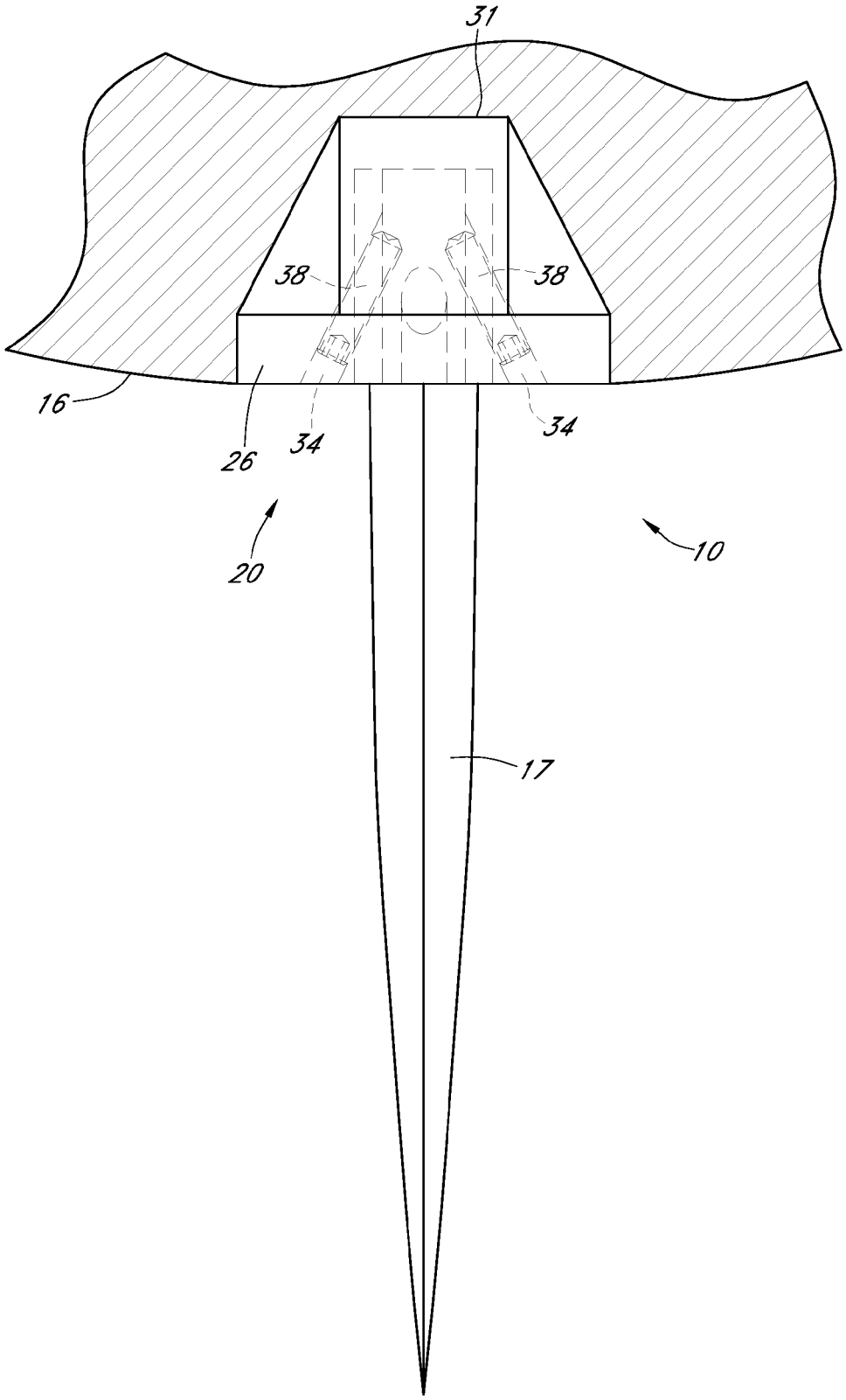
FIG. 5 is a cross section view of the fin box of FIG. 4 with a fin retained in the fin box.

Turning now to the specific structures of a preferred embodiment of fin boxes according to the invention for centre and outside fins able to accept a multiplicity of commercially available fins, both with in-line and canted fin-tabs. With reference to FIG. 4 a centre fin box 20 is constructed as a generally elongate body 22 provided with a recess 24. Body 22 has a first surface 25 which, when fin box 20 is installed in the body of a surfboard (as shown in FIGS. 1 and 5) is generally flush with the surface of the underside 16 of the board 10. First surface 25 includes a peripheral flange 26 extending outwardly from the body 22.

Figure 6:
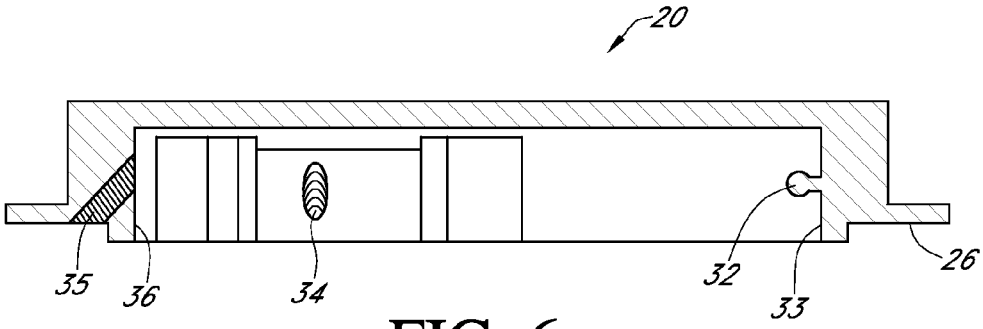
FIG. 6 is a side cross section view of the fin box of FIGS. 4 and 5.
Figure 7:
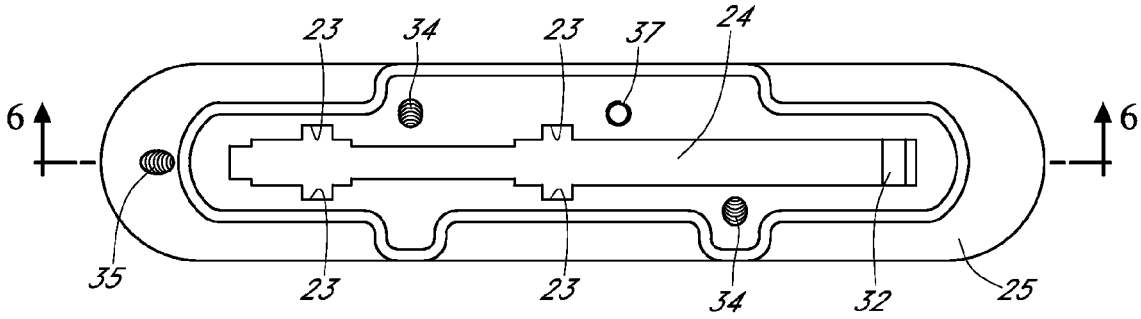
FIG. 7 is a plan view of the fin box of FIG. 6.

Recess 24 extends into the body to a depth sufficient to accept any of the fin-tabs of the commercially available fins shown in FIG. 3. As best seen in FIGS. 4 and 5, body 22 is further provided with a pair of buttress elements 28 at each side of body 22, extending from the upper surface of flange 26 and tapering to the edge of surface 31. Angled threaded holes 34A and 34B are provided along each side of recess 24, passing from surface 25 to emerge at inside surfaces of the recess as best seen in FIGS. 5, 6 and 7. A further angled threaded hole 35 emerges at the forward inside end wall 36 of recess 24. A vertical threaded hole 37 is also provided as shown in FIGS. 4, and 7.

Figure 9:
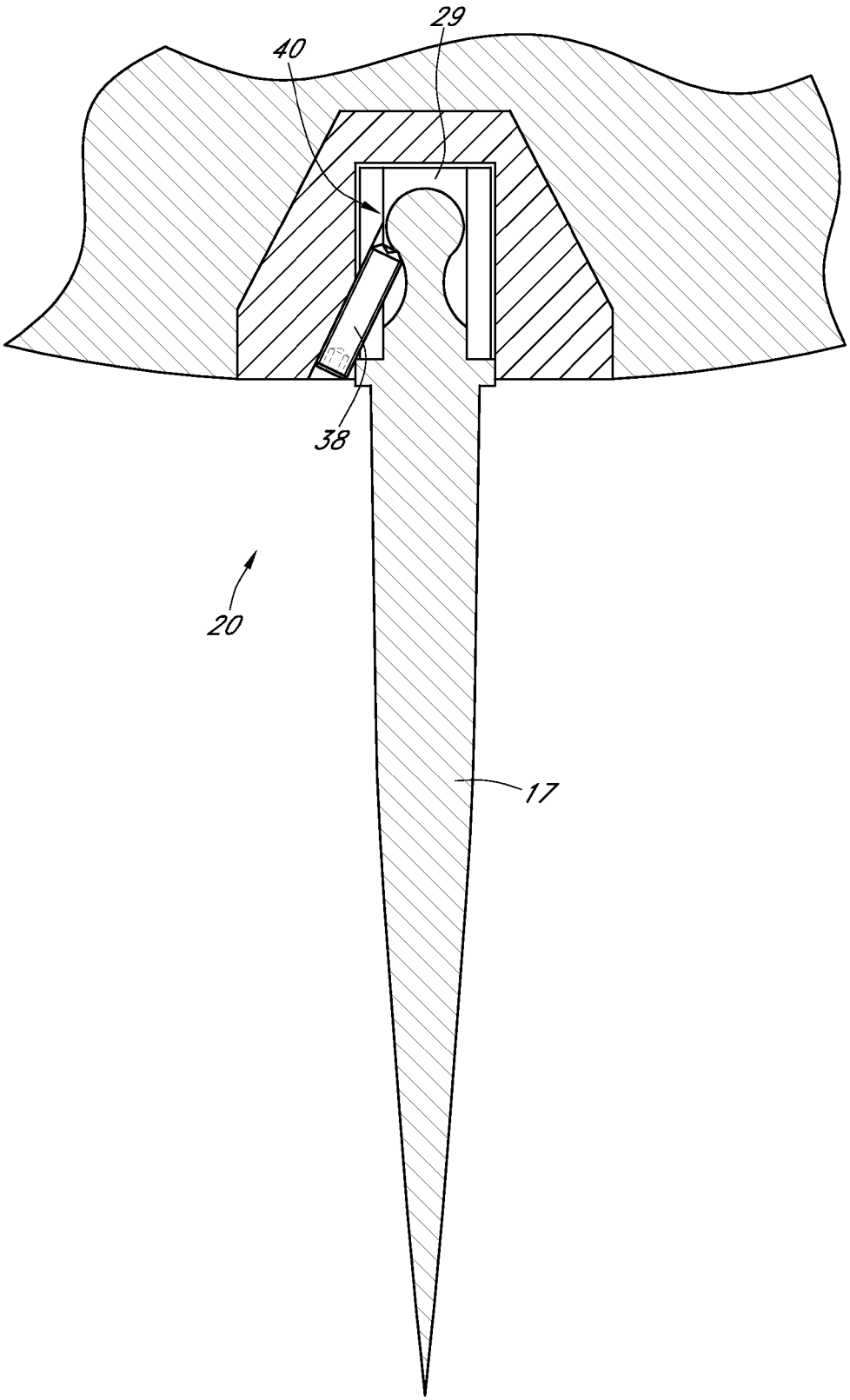
FIG. 9 is a sectioned end view of the fin box of FIGS. 6 and 7 when fitted with fin 3A of FIG. 3.

The width and configuration of the recess is such as to allow insertion of the fin-tabs shown in FIG. 3. Thus for example, the lateral recesses 23 extending outwardly from the main recess 24 are adapted to accept the projecting elements 30 of fin-tab 29 of fin 3A in FIG. 3. As can be seen in FIG. 9 the fin-tab of fin 3A may be securely retained in recess 24 of fin box 20 by a set-screw 38 driven into the angled threaded hole 34A on one side of recess 24 and engaging with cylindrical portion 40 of the fin-tab.

Figure 10:
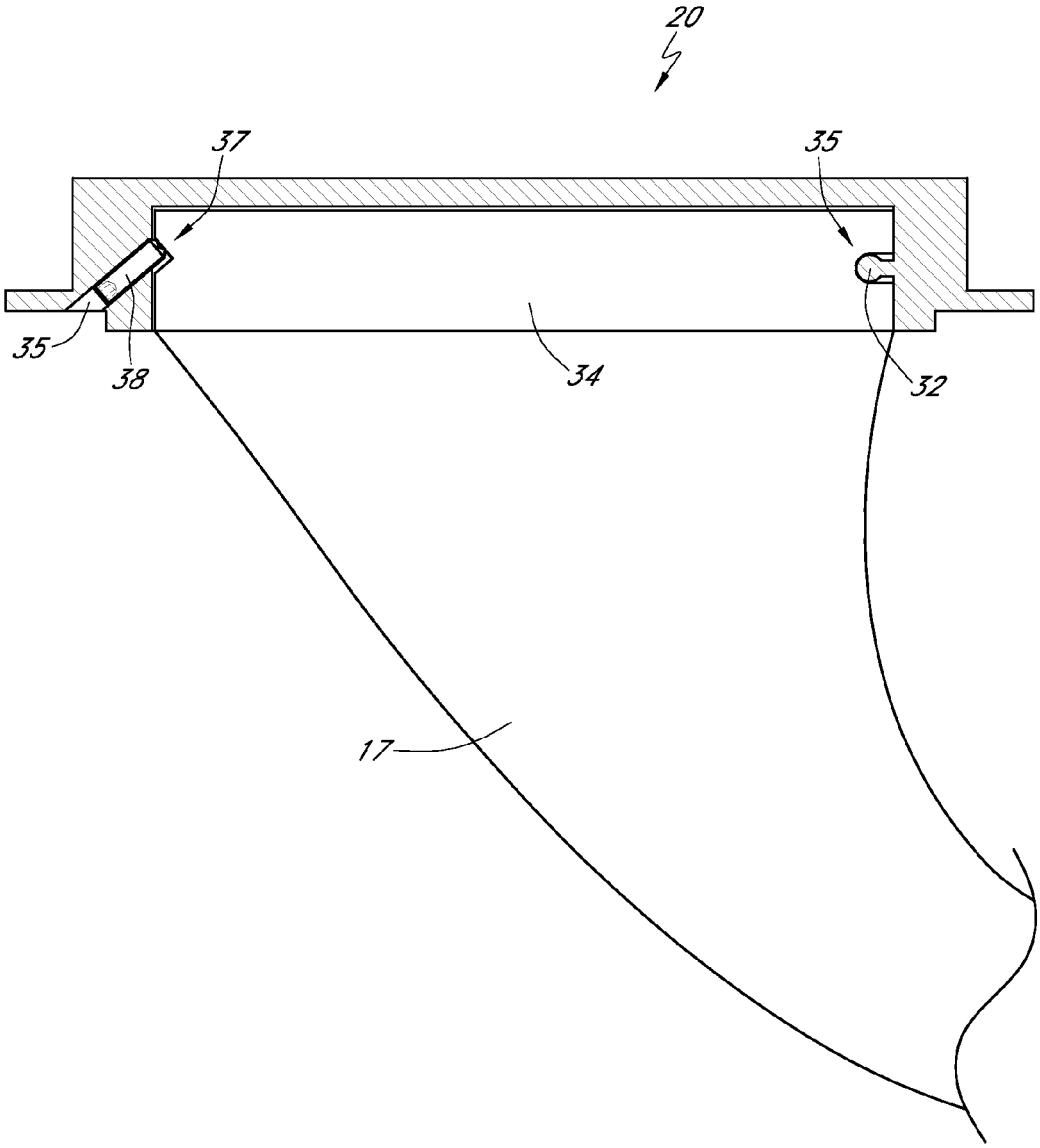
FIG. 10 is a sectioned side view of the fin box of FIGS. 6 and 7 when fitted with fin 3C of FIG. 3.

With reference to FIGS. 6 and 7, recess 24 is provided with a retention member 32 extending across the width of recess 32 and projecting from the rearward end wall 33 of recess 24. Retention member is adapted for engagement with a rear notch 35 in the fin-tab 34 of fin 3C (shown in FIG. 3). As shown in FIG. 10, fin-tab 34 of fin 3C is retained in fin box 20 at the rear by the engagement of notch 35 with retention member 32, and at the front by set-screw 38 engaging front notch 34. Additionally, set-screws 38 (not shown in FIG. 10), may be driven through angled threaded holes 34A and 34B against the sides of fin-tab 34.

Figure 8:
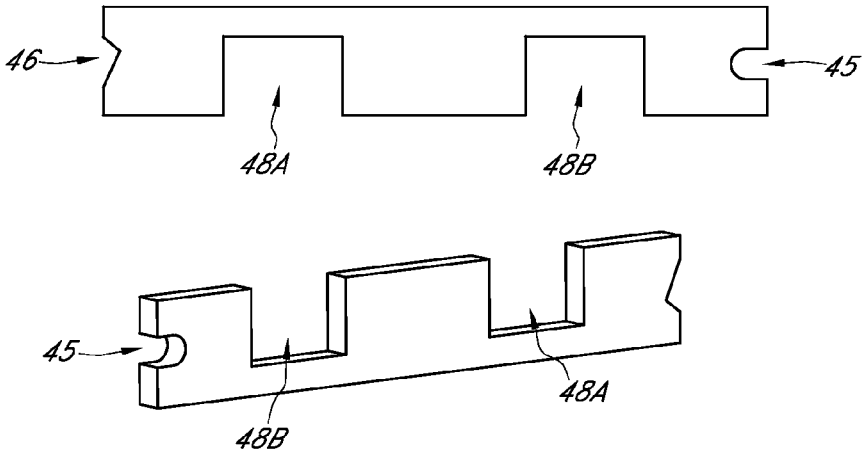
FIG. 8 is a side and perspective view of an insert for use with the fin box of FIGS. 6 and 7.

The fin 3B shown in FIG. 3 has a fin-tab made up of two sections 42A and 42B. To accommodate this fin-tab in the fin box of the present embodiment of the invention, there is provided an insert 44A shown in FIG. 8. Insert 44A is of similar external dimensions as the fin-tab 34 of fin 3C, and is provided with similar rear notch 45 and front notch 46 to enable the insert 44A to be retained in fin box 20 by retention member 32 and the set screw through front threaded hole 35. Insert 44A is further provided with cut-out portions 48A and 48B, sized to receive fin-tab sections 42A and 42B. These sections are then secured in fin box 20 by set-screws driven through angled threaded holes 34A and 34B with the set-screws driving up against the sides of fin-tab sections 42A and 42B.

Figure 15:
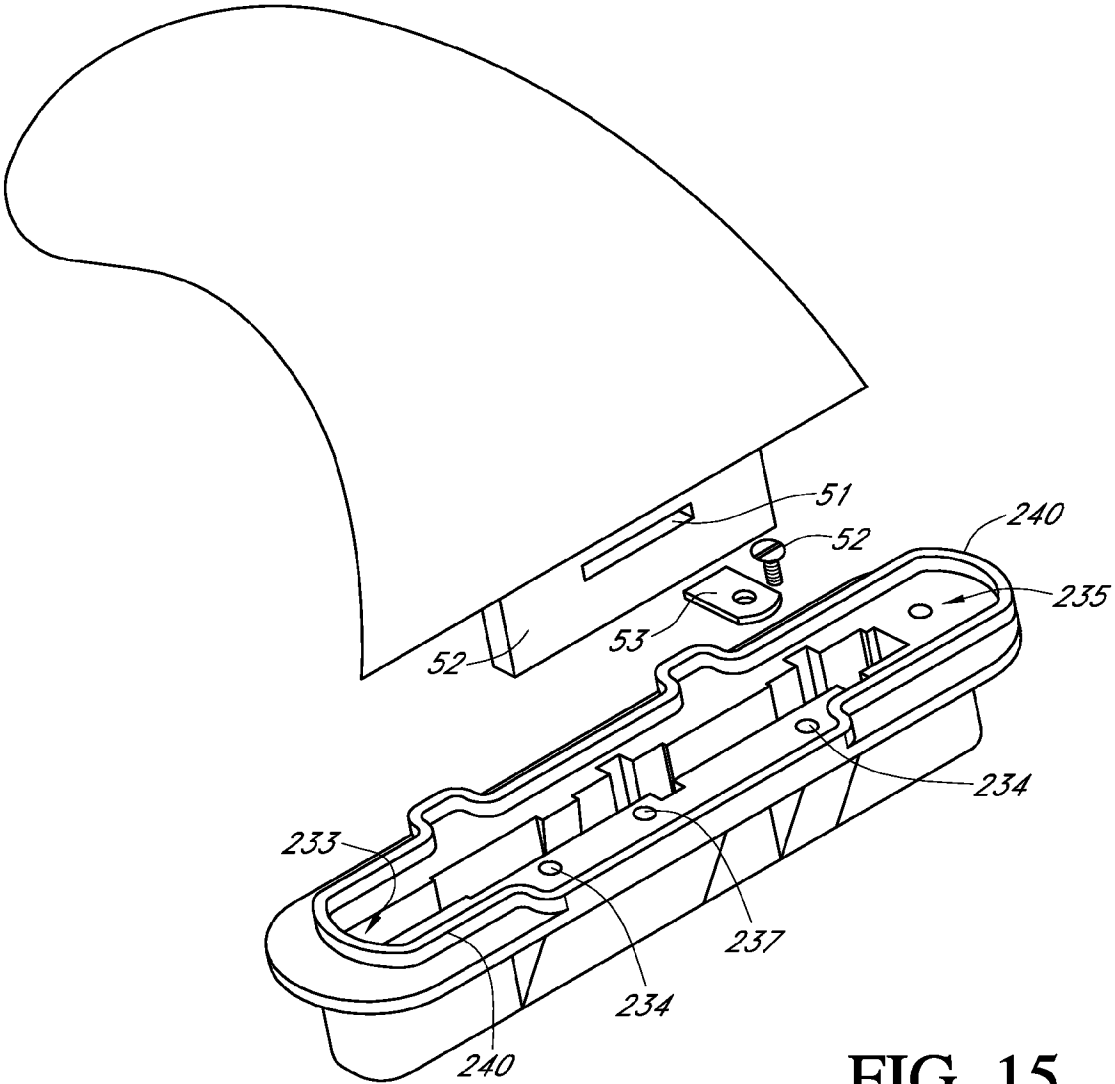
FIG. 15 is a perspective view of the fin box of FIG. 4 showing a further retaining system for fin 3D of FIG. 3.
Figure 16:
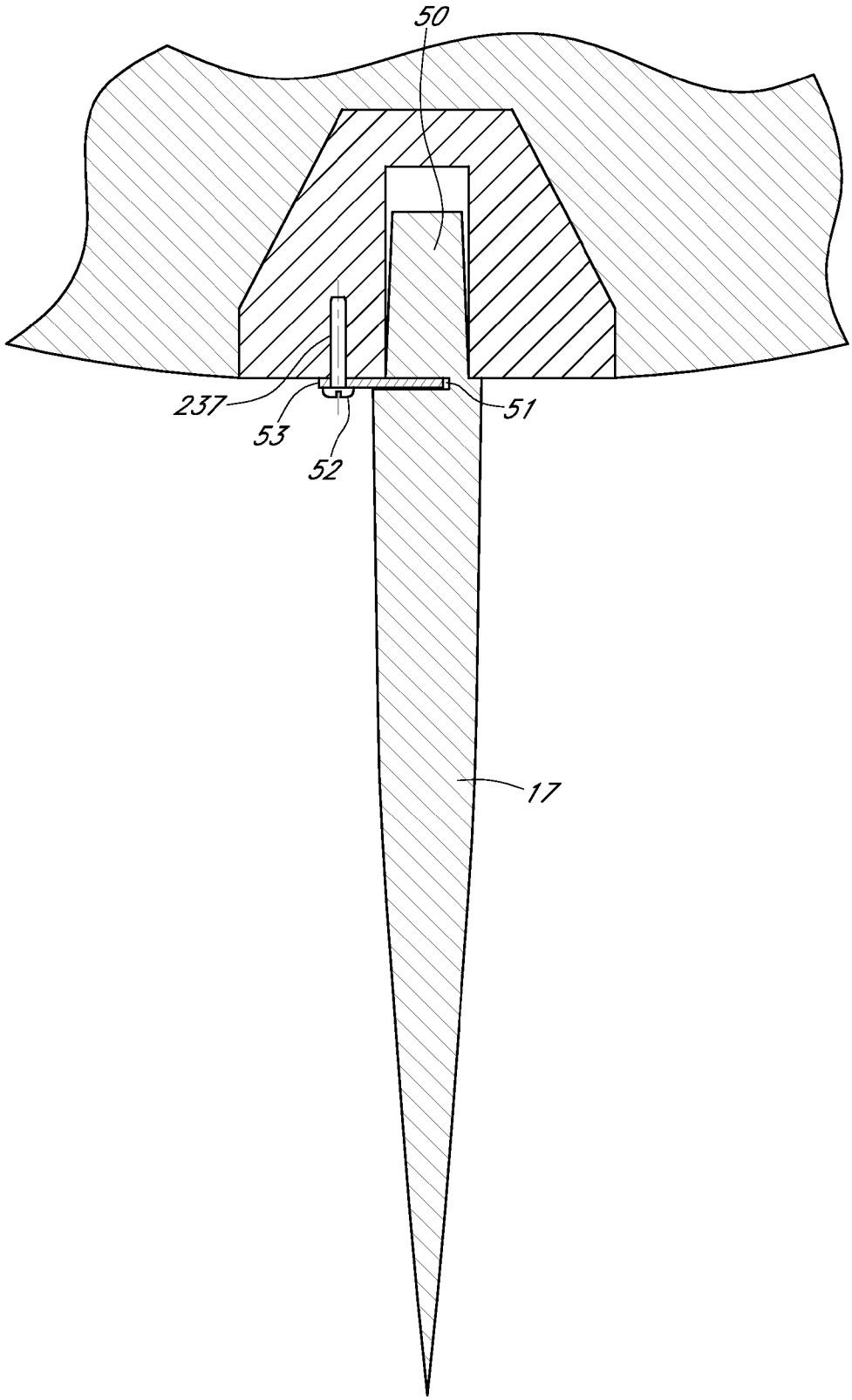
FIG. 16 is a sectioned end view of fin 3D retained in the fin box of FIG. 4.

With reference to FIGS. 15 and 16, fin 3D (shown in FIG. 3), has a fin-tab 50 with slot 51 at the interface between the fin and the tab. This fin, once inserted into the recess 24 of the fin box, is retained by a plate 53 inserted into slot 51 and secured to the fin box by screw 52 screwed into vertically threaded hole 237.

The side fin boxes 13 and 14 are of similar configuration to that of the centre fin box thus far described, but have recesses that are somewhat modified. The left and right fin-boxes are of symmetrical configuration and only the left fin box will be described in detail.

Figure 11D:
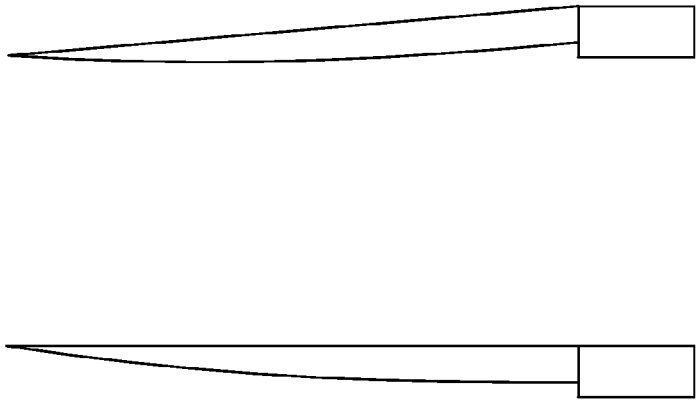
FIG. 11D is an end view of a side fin with a canted fin-tab.
Figure 11C:
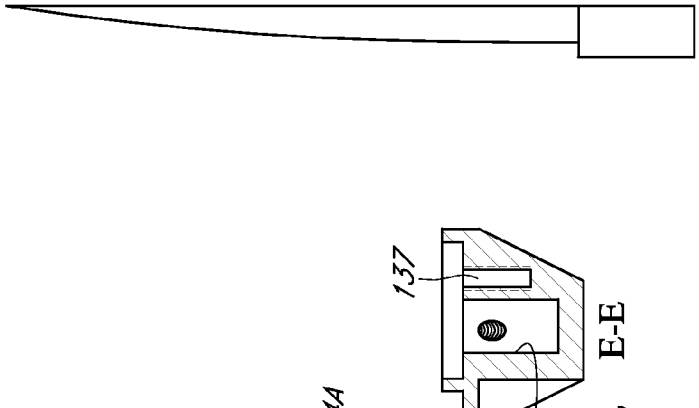
FIG. 11C is an end view of a side fin with an in-line fin-tab.
Figure 11B:
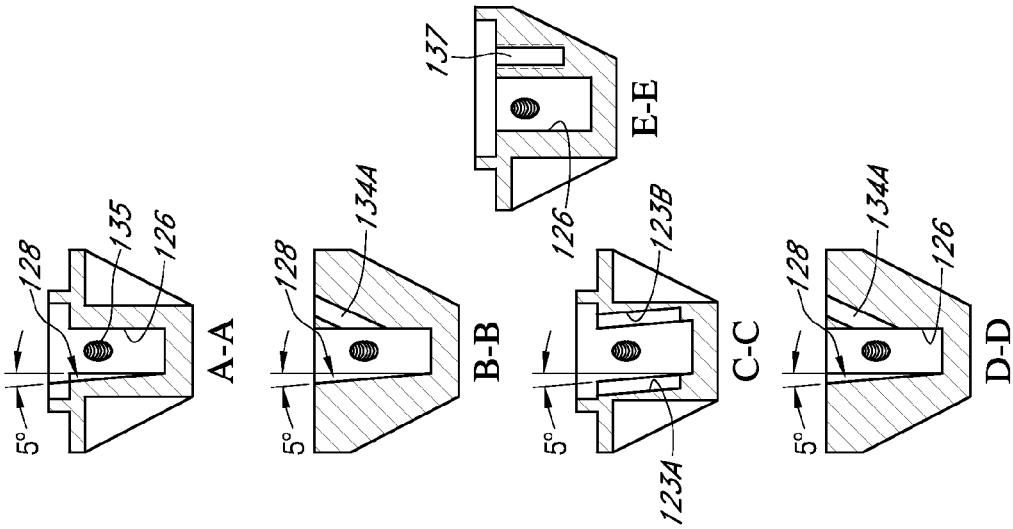
FIG. 11B is a series of cross sections taken along the length of the fin box of FIG. 11A.
Figure 11A:
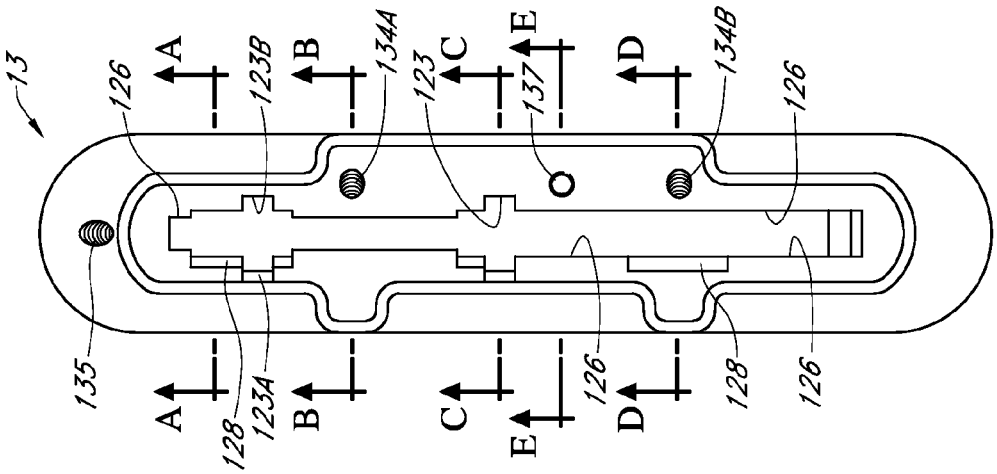
FIG. 11A is a plan view of a left side fin box.

FIG. 11A shows a plan view of the flanged face of a fin box 13 for the left fin of a three-fin surfboard. The recess 124 of this box has sections 128 of the inside wall of the recess closest to the outside edge of the surfboard (to the left in FIG. 11A) sloping outwardly by 5 degrees as indicated by the sectional views A—A to D—D in FIG. 11B. The opposing end walls 123A and 123B of lateral recesses 123 which extend outwardly from main recess 124, slope inwardly so as to be parallel to the modified sloping wall sections of the recess 124 towards the outside edge of the surfboard, as can be seen in section C—C.

The outward sloping sections 128 at A—A to D—D are so placed within recess 124 as to accommodate side fin configurations with in-line fin-tabs such as shown in FIG. 11C and canted fin-tabs as shown in FIG. 1D. Of the fin-tab configurations shown in FIG. 3, which may be accommodated in the fin box of the present invention, fins 3A and 3B have in-line fin-tabs for both left and right fins, while fin 3C and fin 3D have fin-tabs canted by 5 degrees for the left and right outside fins.

It will be seen from the placement of the outwardly sloping sections 128 of recess 124 in FIGS. 11A and 11B, that in-line fin-tab 29 of fin 3A when inserted into recess 124, will be canted outwardly by 5 degrees, since all the vertical faces of that fin tab will slide into those sections at A—A, B—B and C—C which have the side surfaces sloping at 5 degrees.

Figure 13:
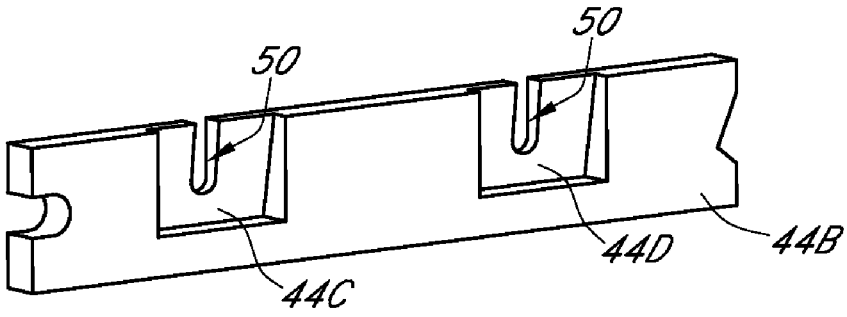
FIG. 13 is a perspective view of an insert for use in the fin box of FIG. 11A.
Figure 14:
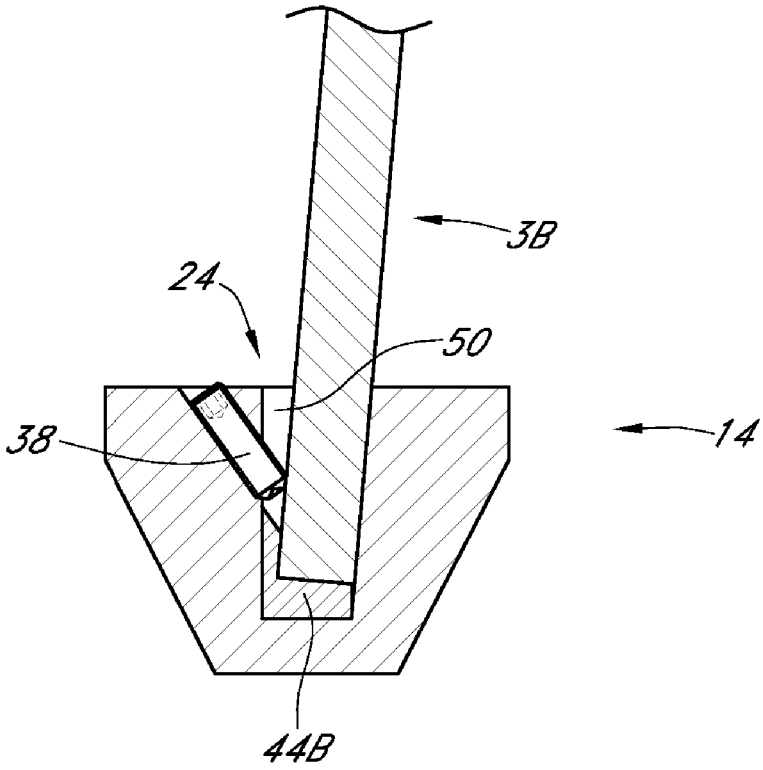
FIG. 14 is sectioned view of a fin inserted in the fin box of FIG. 11A with the insert of FIG. 13.

Likewise, the fin-tab configuration of fin 3B will be accommodated at sections B—B and D—D, when combined with the insert 44B of FIG. 13 as previously described, but which, for this insert has a 5 degree cant built into cut-out portions 48C and 48D. FIG. 14 shows fin 3B located in recess 24 with insert 44B, and locked in place by a set-screw through angled threaded hole 135.

Fin-tab 34 of fin 3C, and fin-tab 50 of fin 3D however need to be retained in the fin box without the 5 degree cant. This is achieved by the remaining sections 126 of recess 124, which retain parallel vertical walls.

As well, fin box 13 is provided with one pair of angled threaded holes 134A and 134B only along that side of the recess 124 away from the outside edge of the surfboard (that is to the right in FIG. 11A). Thus the in-line fin-tabs 29 of fin 3A is driven by the set screw through hole 134A into the desired canted position within recess 124, against the sloping side surfaces towards the outside of the surfboard.

With reference again to FIGS. 13 and 14, the in-line fin-tabs 42A and 42B of fin 3B are positioned at the 5 degree cant by inserting the fin-tabs into the recess portions 48C and 48D of insert 44B. The fin-tabs are then secured by set-screws 38 that pass through slots 50 in recesses 44C and 44D to drive the fin-tabs against the outwardly sloping side surfaces of recess 24 and so canting the fin towards the outside edge of the surfboard by 5 degrees.

Fin-tab 34 of fin 3C, and fin-tab 50 of fin 3D, are retained in the normal vertical orientation as previously described for the centre fin box.

Figure 12:
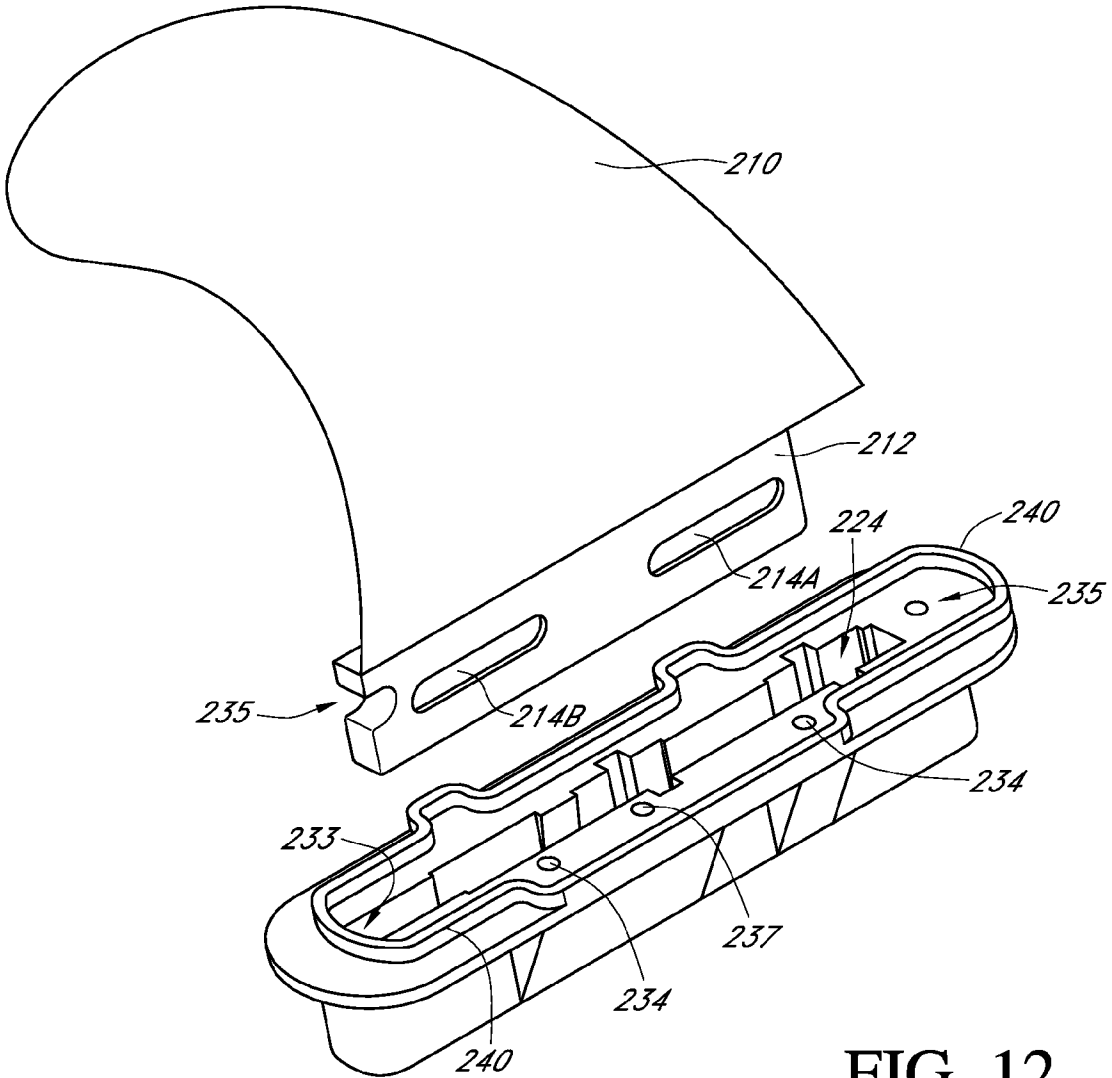
FIG. 12 is a perspective view of a preferred form fin box according to the invention with an adjustable fin.

The centre, left and right fin boxes of the present invention as described above are further able to accept and retain an adjustable fin. As shown in FIG. 12, an adjustable fin 210 is provided with a shortened fin-tab 212. Preferably, fin tab 212 is 20 mm shorter than recess 224, so that fin 210 may be moved forward or rearward by 10 mm from a median position. Fin-tab 210 is still provided with notch 235 so as to allow the fin-tab to be located up against the rear wall 233 and not interfere with the retention member (32 in FIGS. 6 and 7) when located in its rearmost position. However, fin-tab 212 does not rely for retention in recess 224 on the retention member, nor on the forward set-screw in angled threaded hole 235.

In this embodiment, the fin-tab 212 of fin 210 is provided with recesses 214A and 214B. For a left side fin (as shown in FIG. 12) or right side fin box, both recesses are on one side of the fin-tab, that is, on that side on which the angled threaded holes 234 are positioned. For a centre fin, the recesses are provided one on each side of the tab to correspond with the equivalent angled threaded holes of a centre fin box as described herein above. The length of recesses 214 is such as to permit the set-screws driven through angled threaded holes 234 to engage with the recesses regardless of the user's preferred position of the fin.

Second Preferred Embodiment

In a further preferred embodiment of the invention, the fin boxes are somewhat simplified from those described above and shown in FIGS. 6 to 8 and FIGS. 11 and 12. In this embodiment the left, right and centre fin boxes cater for fins with the fin tab configurations of FIGS. 3B and 3C.

Figure 17:
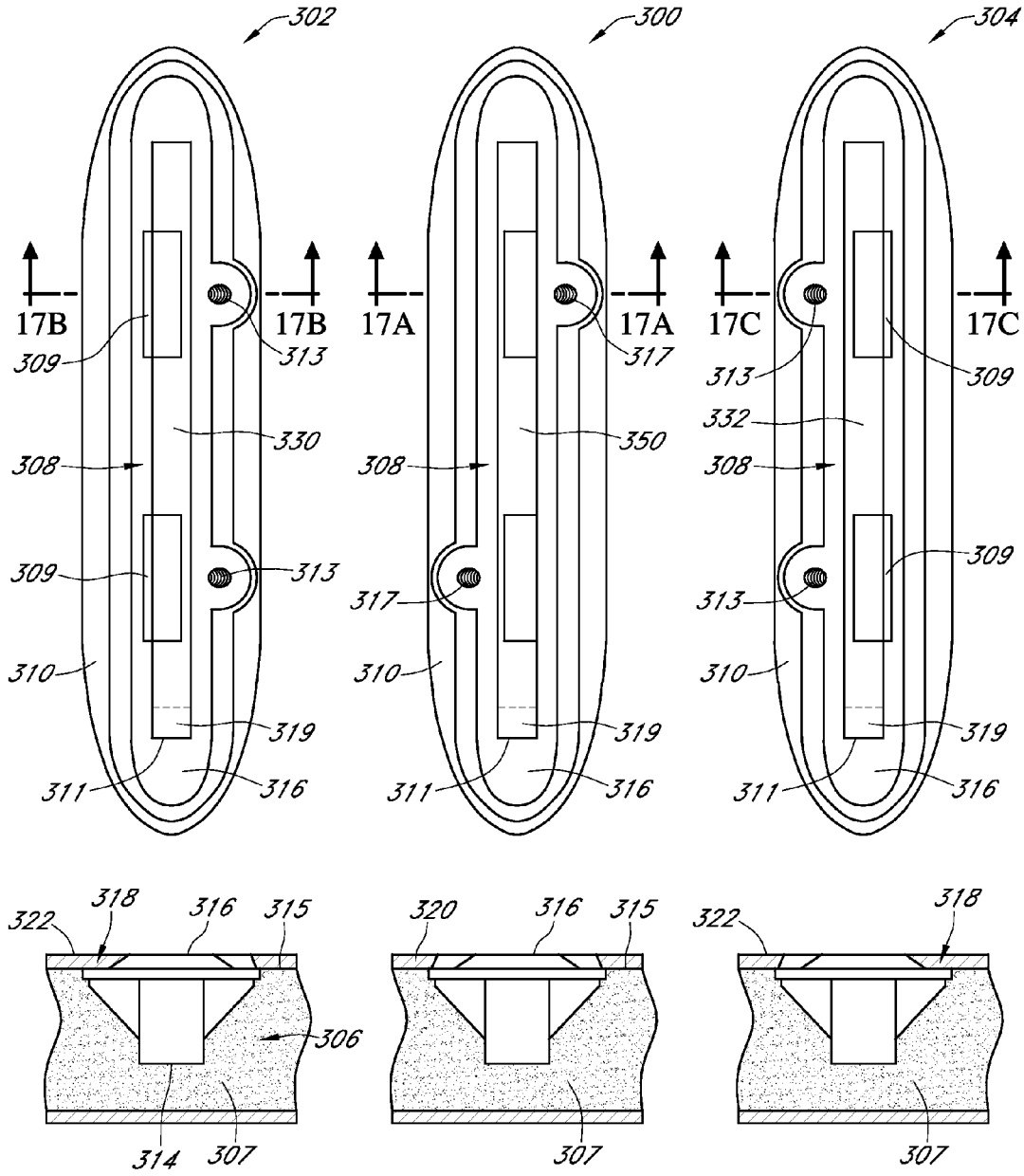
FIG. 17 shows plan and end views of a further preferred embodiment of a left, right and centre fin box.

With reference to FIG. 17, a centre fin box 300, right hand fin box 302 and left hand fin box 304 are each formed as before, as an elongate body 306 provided with a central recess 308 and a peripheral flange 310. As can be seen in the sectioned views of each of FIGS. 17A to 17C, recesses 308 extend from a first outer surface 316 to proximate an opposite inner surface 314. Shown as dashed lines in FIG. 17, and as best seen in FIG. 18, the recess 308 of this embodiment is also provided with a retaining structure 319 projecting from the rearward end wall 311.

First outer surface 316 comprises a first inner portion of peripheral flange 310 around recess 308. An outer portion 318 of flange 310, is offset from first outer surface 316. As can be seen in FIGS. 17, 17A, 17B and 17C, the offset between first outer surface 316 and the outer portion 318 of flange 310 is such that when the fin boxes are installed in the body of a surfboard, the surface of outer portion 318 is flush with the surface 315 of the foam core 307 of a surfboard and the first outer surface 316 is then flush with surface 322 of the finished outer fibreglass skin 320 of the underside surface 322.

The length and breadth of first outer surface 316 which, though flush with the surface 322 of the surfboard, remains exposed, is such that no part of a fin installed in a fin box 300, 302 or 304 is in contact with the underside surface 322. The fin blade is thus fully supported by and within the extent of first outer surface 316.

Figure 17C:
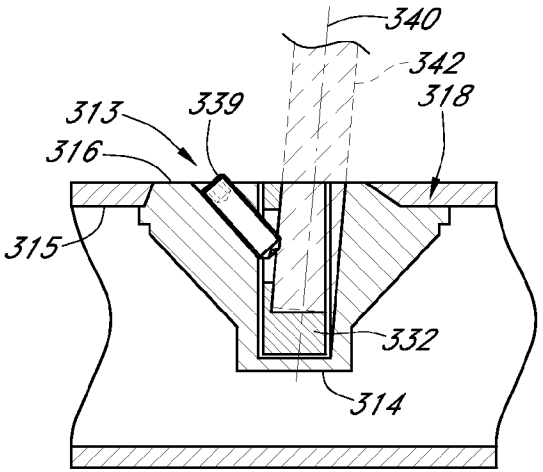
FIGS. 17A, 17B and 17C are sectioned end views of the left, right and centre fin boxes of FIG. 17.
Figure 17A:
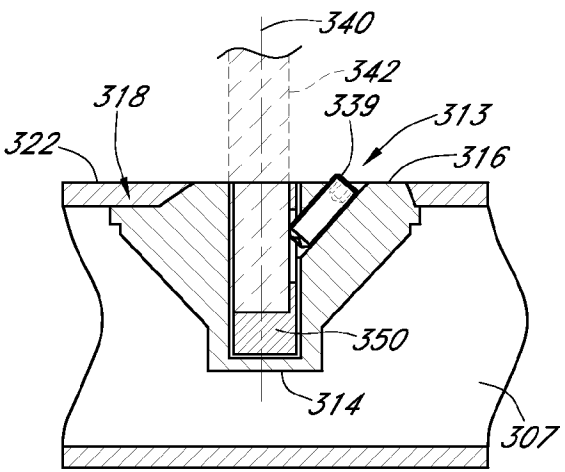
Figure 17B:
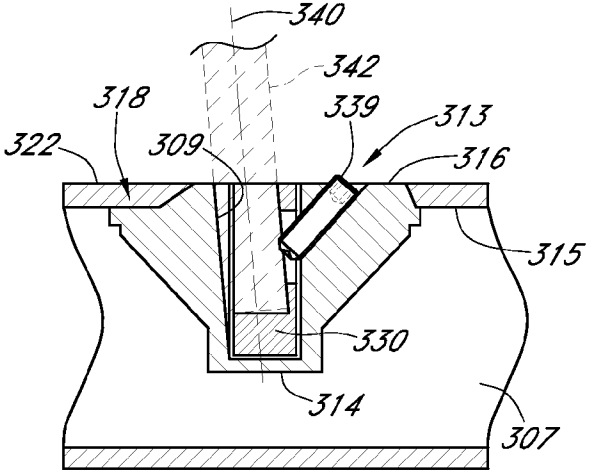
Figure 18:
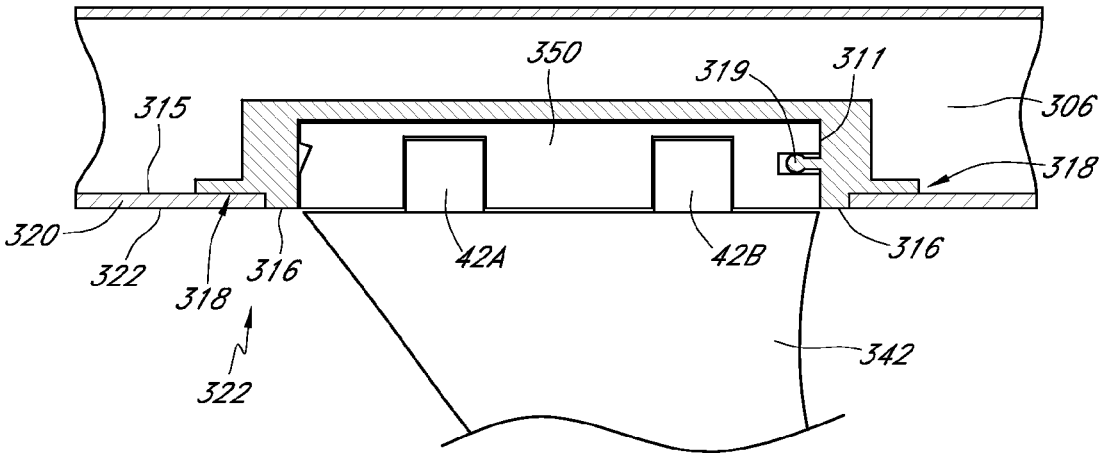
FIG. 18 is a sectioned side elevation view of one of the fin boxes of FIGS. 17, and 17A to 17C with a dual fin-tab fin installed.

With reference to FIGS. 17, 17B and 17C, the right hand fin box 302 and left hand fin box 304 of this embodiment are each provided with two outwardly sloping wall sections 309. Outwardly sloping wall sections 309 of fin boxes 302 and 304 slope towards the right hand side and left hand side respectively of a surfboard. The length and disposition of sloping wall sections 309 conforms to the length and spacing of the dual fin-tabs 42A and 42B of the fin-tab configuration "B" of FIG. 3. Provided opposite each sloping wall section 309 is an angled threaded hole 313 passing from first outer surface 316 to the adjacent sidewall of recess 308.

The right hand and left hand fin boxes 302 and 304 respectively of the present embodiment are provided with a right hand removable insert 330 and a left hand removable insert 332 respectively as shown in FIGS. 17, 17B and 17C.

Figure 18A:
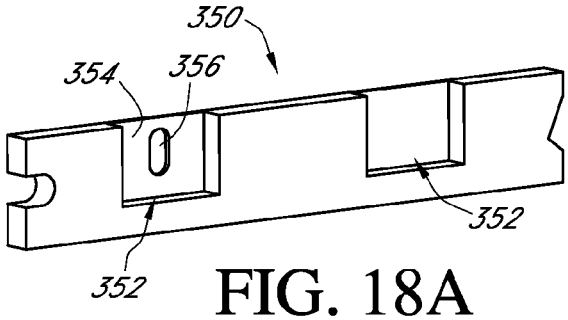
FIGS. 18A, 18B and 18C are detailed perspective views of inserts for the centre, left and right hand fin boxes of FIGS. 17 and 17A to 17C.
Figure 18B:
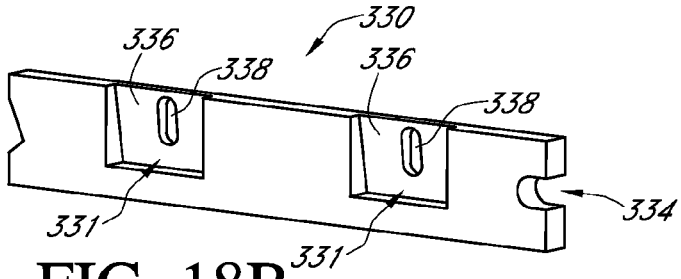
Figure 18C:
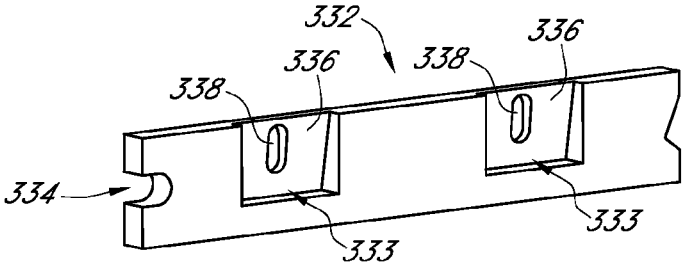

Removable inserts 330 and 332 are of a length, width and depth such as to substantially fill recesses 308. With reference to FIGS. 18B and 18C, removable insert 330 and 332 are each provided with a notch 334 at the rearward end of the insert, adapted to releasably engage with the retaining structures 319 of recesses 308.

Removable inserts 330 and 332 are each further provided with a pair of receiving recesses 331 and 333 respectively. The length and disposition of recesses 331 and 333 are such that when the inserts are inserted into the respective recesses 308 of right hand fin box 300 and left hand fin box 302, the receiving recesses coincide with sloping wall sections 309. Inner walls 336 of receiving recesses 331 and 333 are provided with slots 338 to allow set screws 339 driven through angled threaded holes 313 to pass through the slots 338 and engage with the dual fin-tabs of a dual fin-tab fin.

The inner walls 336 of receiving recesses 331 and 333 slope inwardly with the same degree of slope as that of sloping wall sections 309 of recesses 308, so that with the inserts located in recesses 308 the sloping wall sections 309 are parallel to the inner walls 336 of receiving recesses 331 and 333. The separation between these opposing parallel walls conforms to the thickness of the dual fin-tabs 42A and 42B of FIG. 3.

As can be seen in the sectioned views of FIGS. 17B and 17C, since these dual fin-tabs are in-line with the median plane 340 of the fins 342, the fins 342 assume an outwardly canted angle relative to the underside surface 322. Thus a dual fin-tab fin inserted into right hand fin box 302 fitted with removable insert 330, is canted towards the right hand side of a surfboard, while an identical fin likewise inserted into the left hand fin box 302 and its associated removable insert 332, is canted towards the left hand side of the surfboard.

With reference now to FIGS. 17 and 17A, the recess 308 of centre fin box 300 is not provided with sections of sloping walls; opposing sidewalls being parallel and vertical relative to the underside 322 of a surfboard. The centre fin box 300 is also provided with two angled threaded holes 317 spaced apart and located along the length of the recess as are the threaded angled holes 313 of the right hand and left hand fin boxes, but disposed one on either side of recess 308.

Centre fin box 300 is also provided with a removable insert 350 (shown in FIG. 18A) of similar outward configuration and dimensions as the removable inserts 330 and 332 for the right hand and left hand fin boxes described above. Removable insert 350 is also provided with receiving recesses 352 sized and positioned along the length of the insert as are the receiving recesses 331 and 333 of the right hand and left hand inserts. However, the rear walls 354 of these recesses are not sloping, so that when the insert 350 is inserted into recess 308 of the centre fin box, the recesses form parallel sided and vertically disposed recesses.

Thus a dual fin-tab fin installed in the centre fin box 300 with its removable insert 350, will be vertical relative the underside 322 of a surfboard. Because of the arrangement of the angled threaded holes of the centre fin box, only the rear wall 354 of the rearward receiving recess need be provided with a slot 356 for a securing set screw to pass through.

Figure 19:
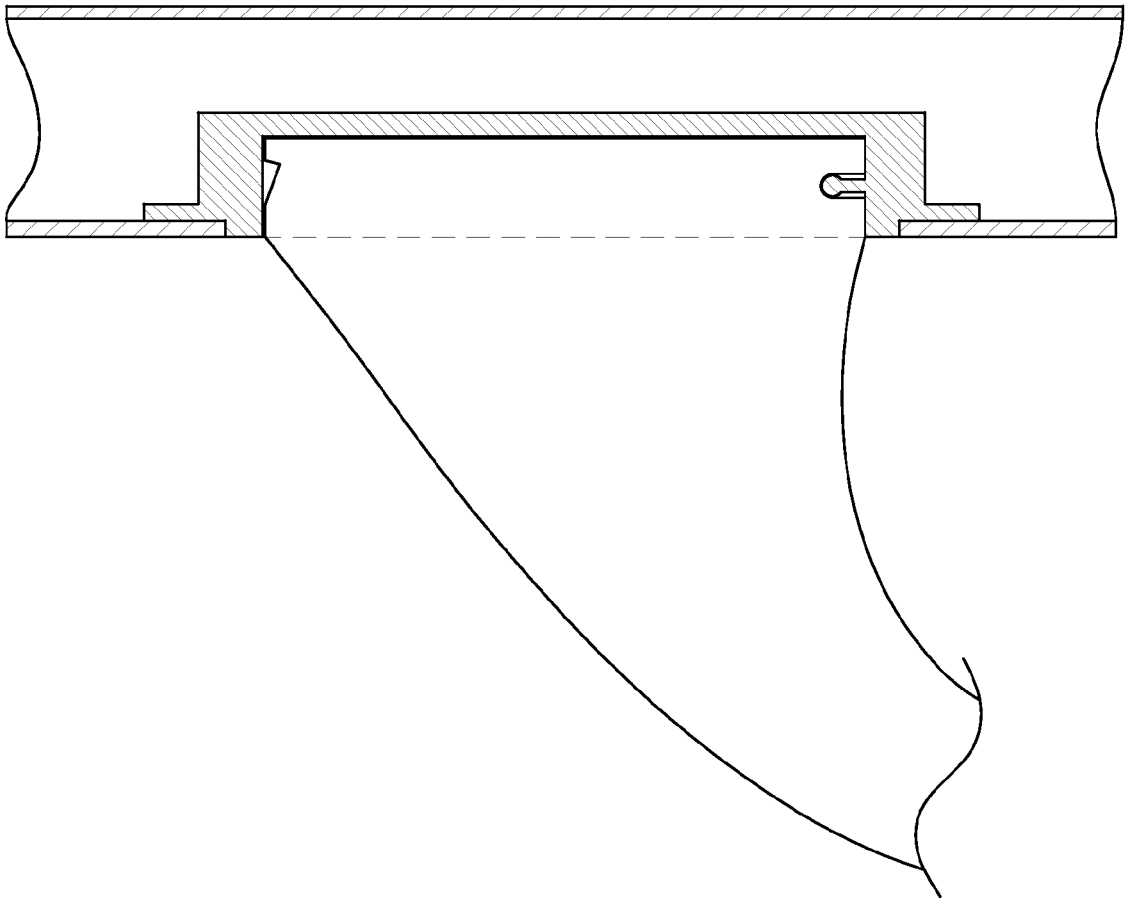
FIG. 19 is a sectioned side elevation view of one of the fin boxes of FIGS. 17 and 17A to 17C without an insert and with a fin with the fin-tab of FIG. 3C installed.

With the respective inserts 330, 350 and 332 of the right hand, centre and left hand fin boxes removed, the fin boxes can receive a fin-tab configuration of the type shown as "C" in FIG. 3, as can be seen in FIG. 19. For the right hand and left hand fin to be canted outwardly to the right and left hand sides of a surfboard respectively, fin-tabs canted relative to the plane of the fin as shown in FIG. 11D can be used.

The right hand, centre and left hand fin boxes of the present embodiment are further able to accommodate and allow fore and aft adjustment of fins with the fin-tab configuration shown in FIG. 12. These fins are provided with fin-tabs specific to right hand, centre and left hand fins, with the fin tabs of the right and left hand fins canted relative the blade of the fin so as to set the fin at an outwardly sloping angle relative the underside of the surfboard when the fin-tab is retained between the parallel and vertical opposite walls of the fin box recesses.

Figure 19A:
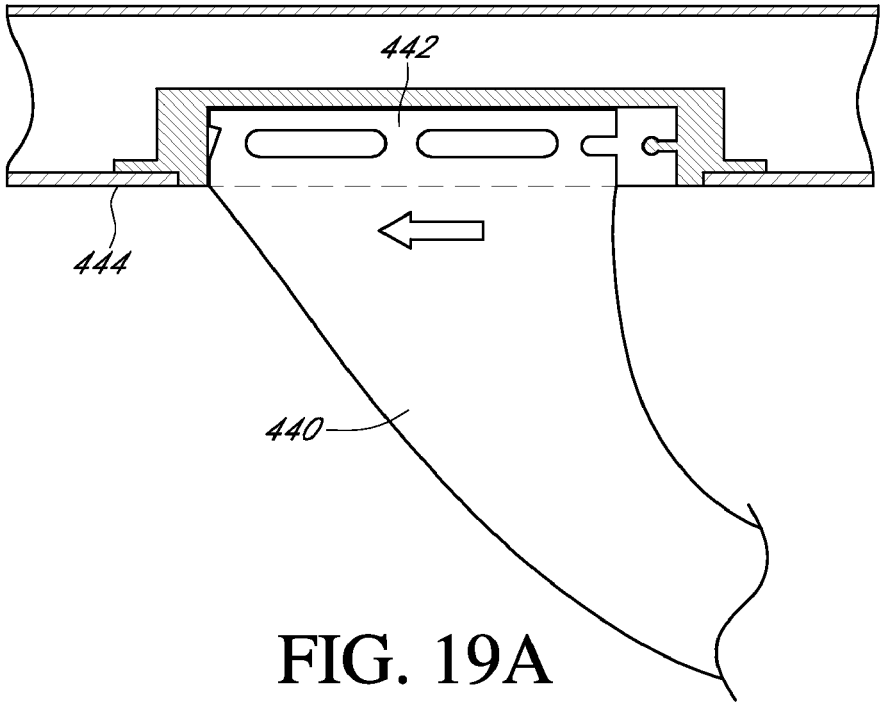
FIGS. 19A and 19B are sectioned views of a fin box with a recess greater in length than the fin-tab of a fin allowing fore and aft adjustment of the location of the fin-tab in the fin box.
Figure 19B:
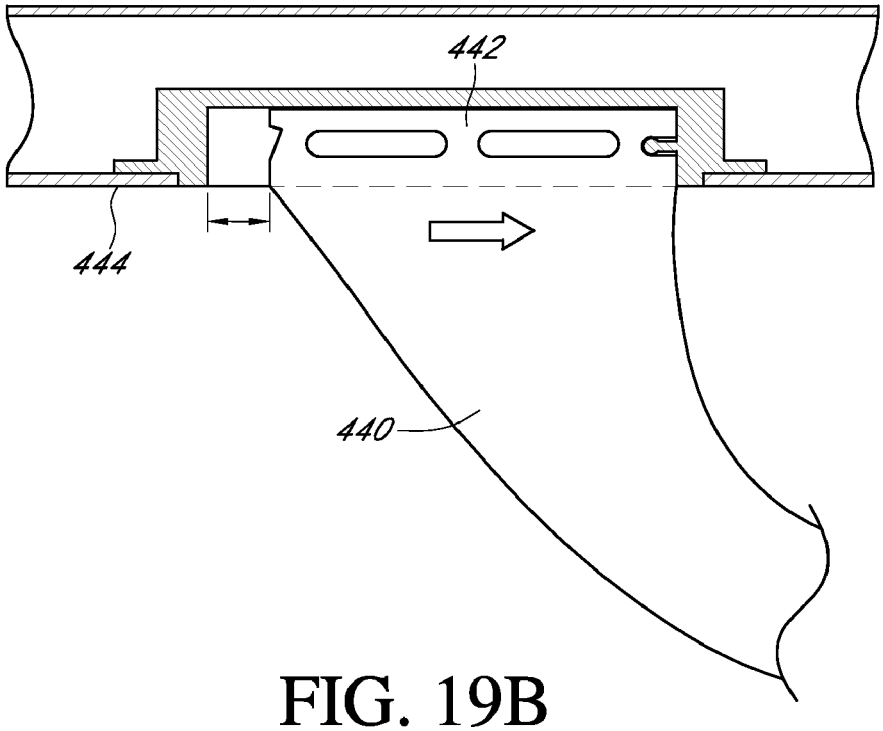

The fore and aft adjustment of this fin-tab configuration is provided by the length of the fin-tab being some 20 mm shorter than the length of the fin box recess. FIGS. 19A and 19B show a fin 440 with a shorter fin-tab 442 in a maximum forward position and a maximum rearward position respectively. The fin-tab 442 is secured in the fin box by the set screws previously described. As well it will be noted that, regardless of the fin's adjusted fore-aft position, the blade is fully supported on the surface of inner portion 316 and is not in contact with the surface 444 of the surfboard.

Third Preferred Embodiment

Figure 20:
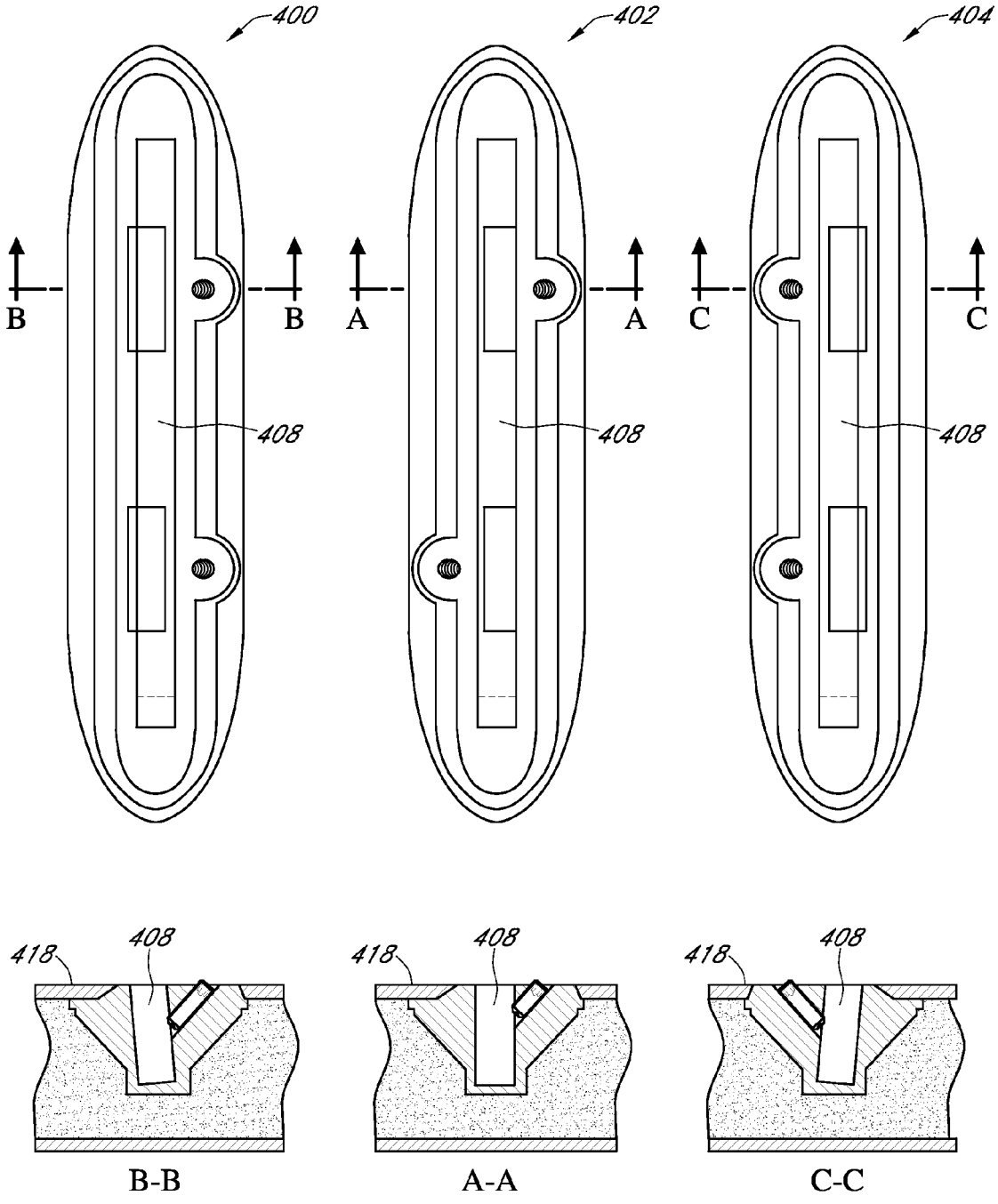
FIG. 20 shows plan and sectioned end elevation views of a further preferred embodiment of a centre, left and right fin box according to the invention.
Figure 21:
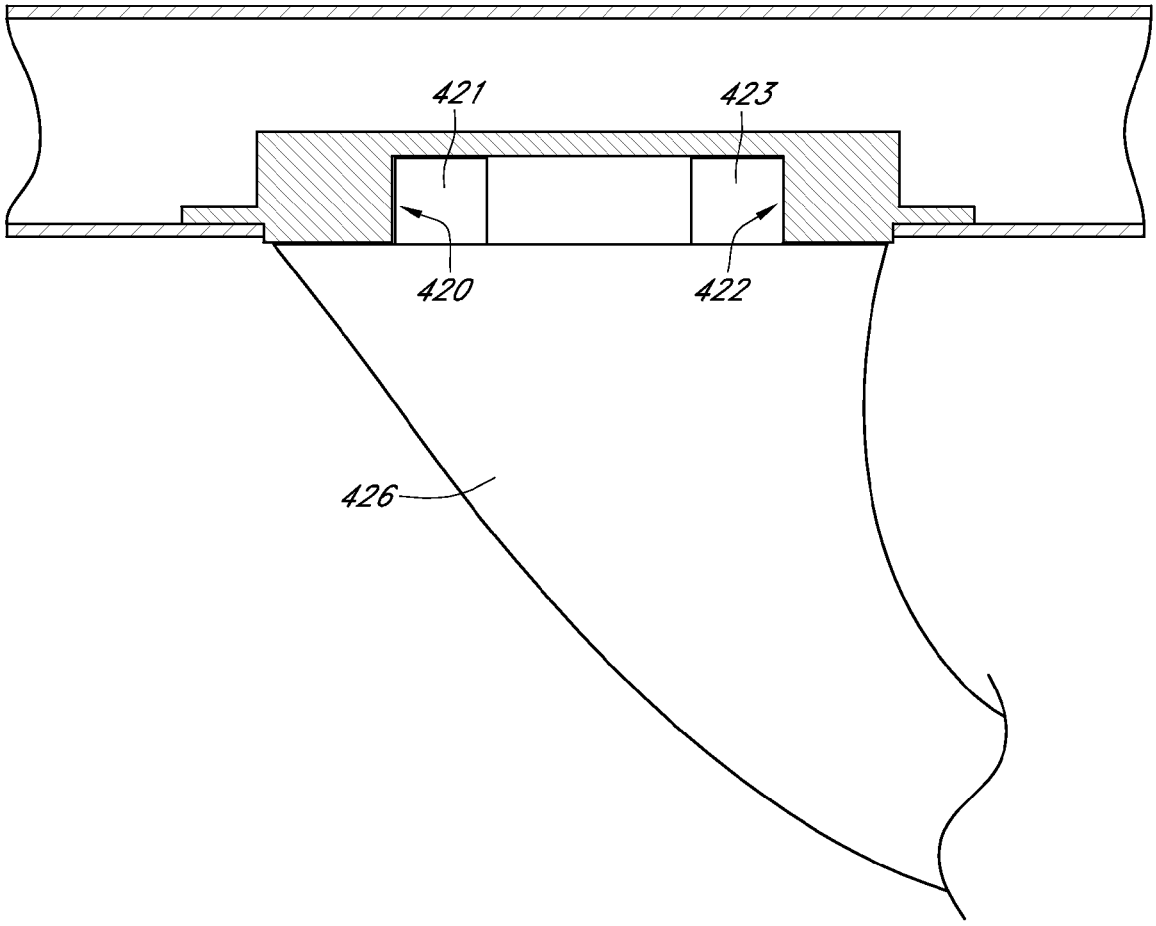
FIG. 21 is a sectioned side elevation view of still a further preferred embodiment of a fin box with a dual fin-tab fin installed.

Turning now to FIGS. 20 and 21, in this further preferred embodiment of the invention, as for the second preferred embodiment described above, a right hand fin box 400, centre fin box 402 and a left hand fin box 404 are provided, all with the same general external configuration of the fin boxes of the second preferred embodiment shown in FIG. 17.

However, in this embodiment, the central recess 408 of each fin box is shortened to a length equal to that from leading edge 420 of the forward fin-tab 421 of a dual fin-tab fin 426, to the trailing edge 422 of the rearward fin-tab 423, as shown in FIG. 21. Also, there is no retaining structure projecting from the rearward end wall of the recess.

For the right hand fin box 400 and the left hand fin box 404, the central recesses 408 have parallel sidewalls canted at an angle to the underside surface 418 of a surfboard, while the sidewalls of the recess of the centre fin box are parallel and vertical.

Figure 21A:
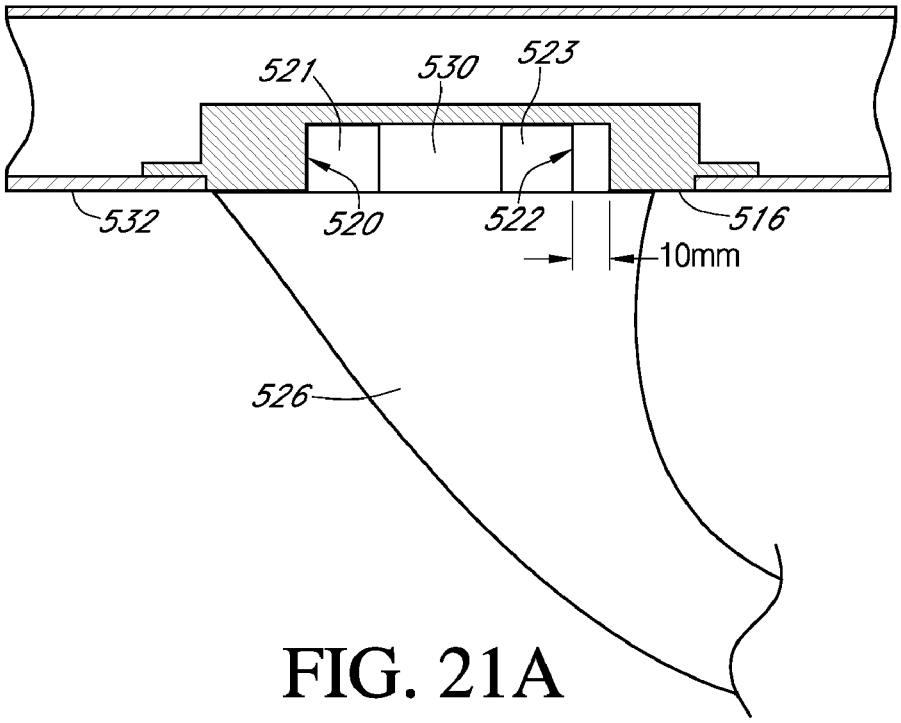
FIGS. 21A and 21B are sectioned side elevation views of a fin with dual fin-tabs installed in a recess of a fin box wherein the recess is of a length allowing fore and aft adjustment of the fin in the fin box.
Figure 21B:
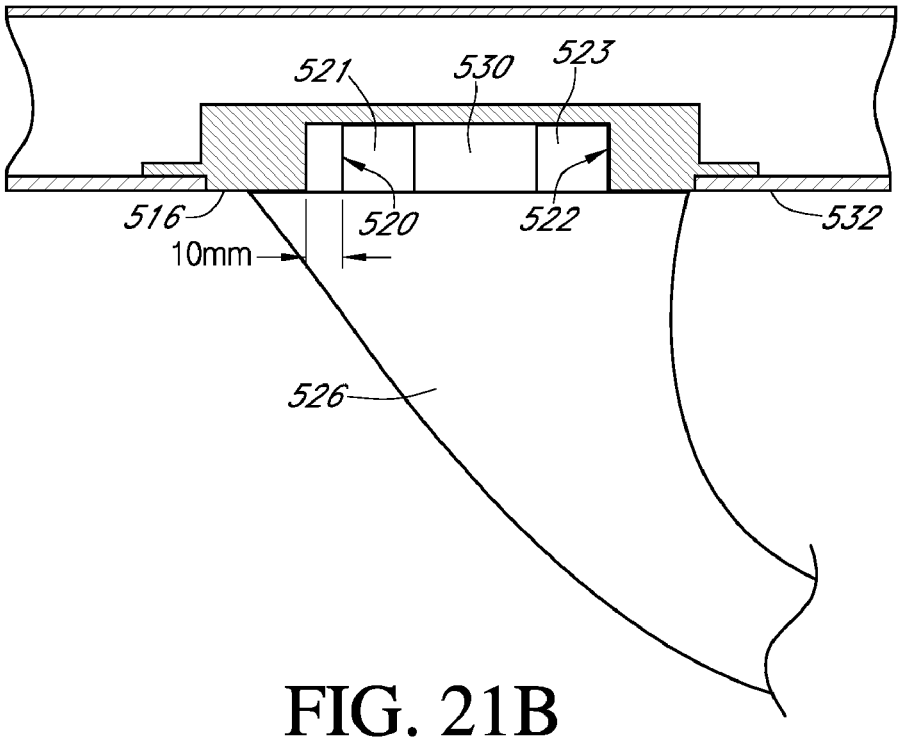

With reference to FIGS. 21A and 21B, fore and aft adjustment of a dual fin-tab fin 526 in the fin boxes may be provided by a recess length longer than the distance between the leading edge 520 of the forward fin-tab 521 and the trailing edge 522 of the rearward fin-tab 523. Thus as shown in FIGS. 21A and 21B, a recess 530, 10 mm longer than the overall length of the dual fin-tabs 521 and 523 will allow the fin 526 to be adjusted plus or minus 5 mm from a median position between the fully forward location of FIG. 21A and the fully rearward position of FIG. 21B. The overall length and breadth of the surface of first outer surface 516 remains such that no part of fin 526 is in contact with the surface 532 of the surfboard.

Fourth Preferred Embodiment

Figure 22:
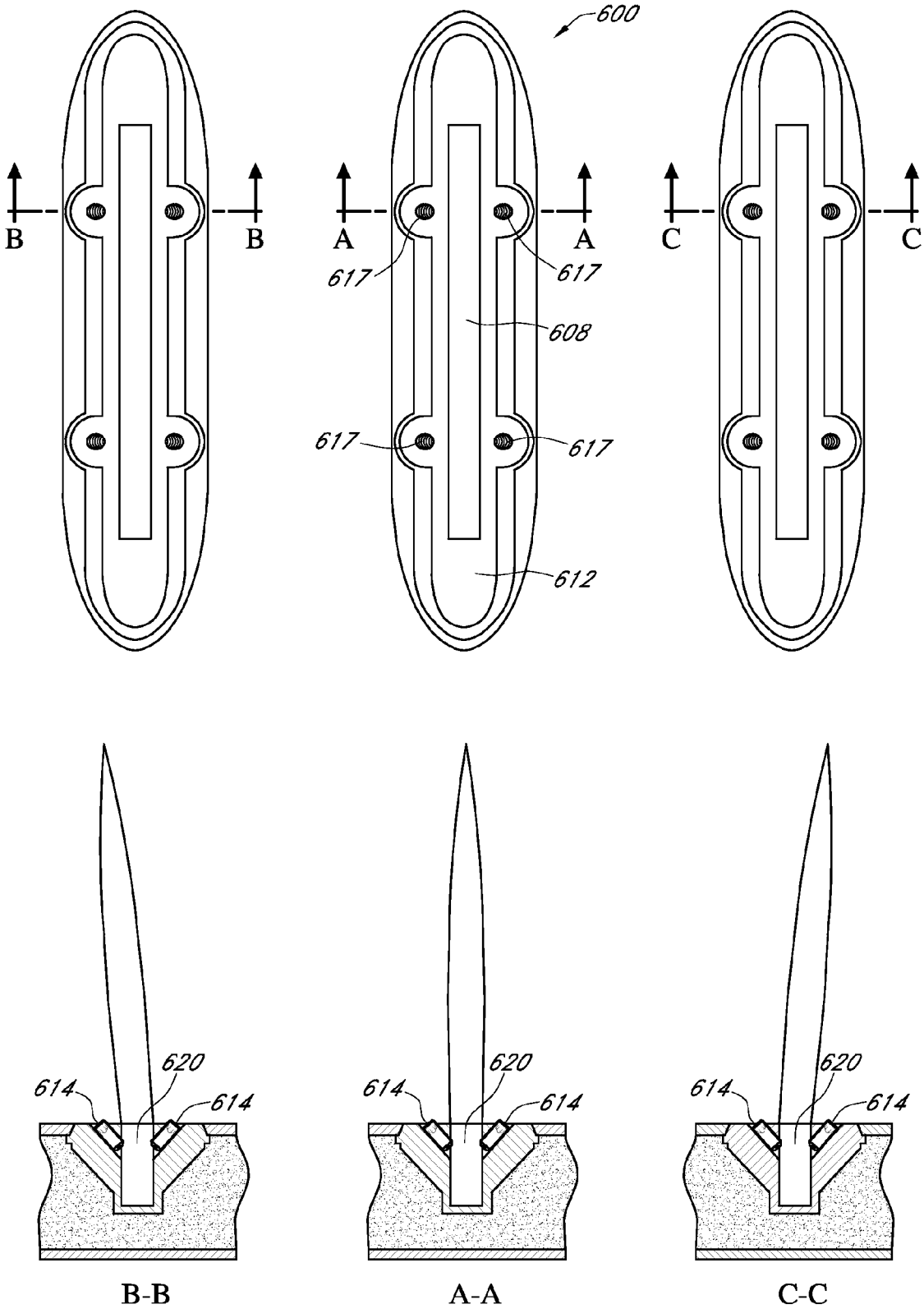
FIG. 22 shows plan and sectioned end elevation views of a further preferred embodiment of a fin box.
Figure 23A:
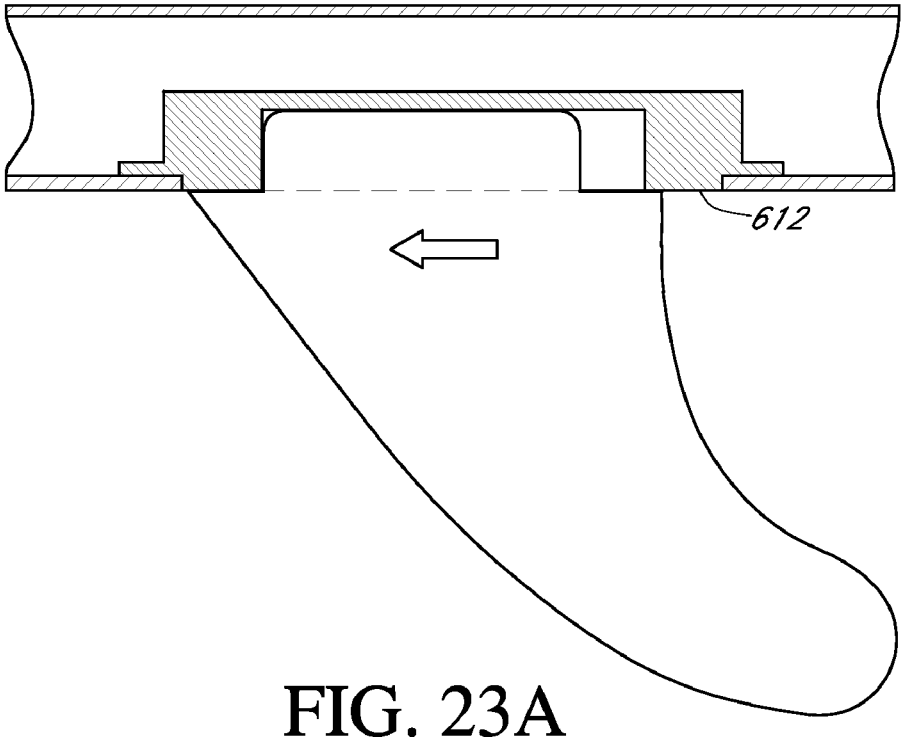
FIGS. 23A and 23B are side views of a further preferred embodiment of the fin box.
Figure 23B:
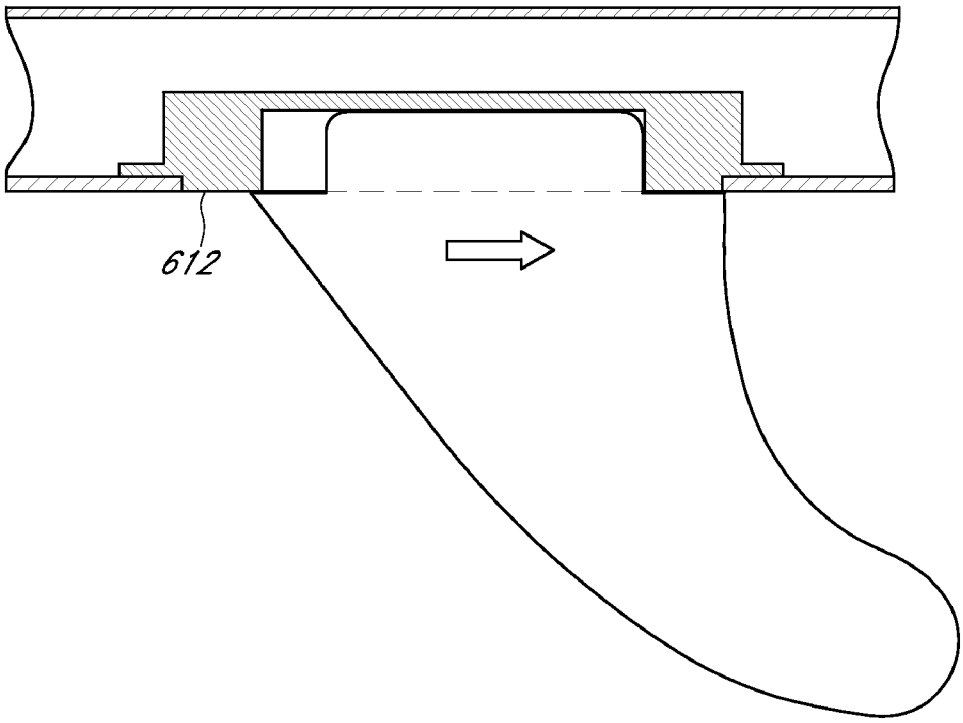

With reference to FIGS. 22 and 23 in a fourth preferred embodiment of the invention, the right hand, centre and left hand fin boxes 600 are identical. The external configuration of fin boxes 600 is as previously described for the second and third preferred embodiments above, but the recess 608 is further simplified to a rectangular section recess with opposing parallel side and end walls, normal to the first outer surface 612.

In this embodiment each fin box is provided with a pair of angled threaded holes 617 at each side of recess 608, and adapted to receive set screws 614 for the retention of one-piece fin-tabs 620.

The fin boxes of this embodiment are adapted for fin-tab configurations where the fin-tab is canted relative to the median plane of the fin for the right hand and left hand fins of a three fin arrangement.

In Use

The fin boxes of the present invention may be incorporated in the body of a surfboard in accordance with known processes. That is the board may be completely finished to the glassed stage, after which suitable recesses are machined through the glassed surface and into the foam of the core. The boxes are then inserted and retained with a suitable bonding agent. Alternatively, a cavity may be formed in the foam core and the box inserted prior to glassing. For this process the box may be provided with a projecting barrier 240 so as to prevent resin flowing into the recess 224 and angled threaded holes 234 and 235.

The above describes only some embodiments of the present invention and modifications, obvious to those skilled in the art, can be made thereto without departing from the scope and spirit of the present invention.

What is claimed is:

1. A structure for releasable attachment of a fin to the body of a water board; said fin including a fin-tab associated therewith; said structure adapted for insertion into and retention within said water board; said structure further adapted for reception and releasable retention of a plurality of fin-tab configurations thereby to releasably retain said fin in fixed relationship to said water board, said structure comprising:

a generally elongate body provided with a substantially rectangular section recess open at a first surface of said body said recess extending to a base proximal to a second surface opposite said first surface, and said recess having a forward end and a rearward end;

a removable retention mechanism positioned within the body that engages with a first configuration of fin tabs, and a fixed retention mechanism positioned within the body that engages with a second configuration of fin tabs.

2. The structure of claim 1 wherein said structure is provided with a peripheral flange extending outwardly from said body; a first surface of said flange forming a continuation of said first surface of said body.

3. The structure of claim 1 wherein said recess is of a length at least equal to the length of a longest one of said plurality of fin-tab configurations.

4. The structure of claim 1 wherein said structure is adapted for bonding into a recess in said water board and arranged so that said first surface of said body is substantially flush with an underside surface of said water board.

5. The structure of claim 1 wherein said removable retention mechanism a first form adapted for reception and releasable retention of one said fin-tab configurations of center fins.

6. The structure of claim 5 wherein said structure is provided in a second and a third form adapted for reception and releasable retention of a plurality of fin-tab configurations of right side and left side fins respectively.

7. The structure of claim 5 wherein said recess of said structure in said first form comprises planar opposing left and right side surfaces parallel to one another and planar opposing forward and rearward end surfaces parallel to one another; each of said surfaces normal to said first surface.

8. The structure of claim 6 wherein said recess of said structure in said second form planar opposing end walls parallel to one another and normal to said first surface; and wherein portions of a right hand side wall surface of said recess slope outwardly and upwardly from said base of said recess at approximately 5 degrees to a plane central to said center fin.

9. The structure of claim 6 wherein said recess of said structure in said third form comprises opposing end walls parallel to one another and normal to said first surface; and wherein portions of a left hand side wall surface of said recess slope outwardly and upwardly from said base of said recess at approximately degrees to a plane central to said center fin.

10. The structure of claim 6 wherein each said recess of said first form, said second form and said third form of said structure is provided with a pair of lateral recesses extending outwardly from each opposite side surface of said recess; said lateral recesses located in a forward portion of said recess.

11. The structure of claim 10 wherein outer walls of said lateral recesses of each of said second form and said third form of said structure are parallel to said wall surface portions sloping outwardly and upwardly.

12. The structure of claim 1 wherein said recess is provided with the fixed retention member extending across the width of said recess and located proximate half the depth of said recess; said fixed retention member projecting forwardly from a surface of said rearward end of said recess.

13. The structure of claim 2 wherein said structure is provided with a pair of buttress portions along each opposite side of said structure; said buttress portions extending from a surface of said flange opposite said first surface of said body; said buttress portions transitioning to respective edges of said second surface opposite said first surface of said body.

14. The structure of claim 13 wherein each said pair of buttress portions is spaced at intervals approximately one third the length of said structure.

15. The structure of claim 13 wherein each forward one of each said pair of buttress portions is positioned approximately halfway between said lateral recesses.

16. The structure of claim 1 wherein said removable retention mechanism is an insert potion adapted to provide support for a selected ones of said plurality of fin-tab configurations.

17. The structure of claim 16 wherein said insert is a retainer plate and the at least one fin-tab of said plurality of fin-tabs is retained in said recess by the retainer plate and a screw passing through said retainer plate into said vertical threaded hole; said retainer plate engaging with a slot in said fin-tab.

18. The structure of claim 1 wherein said structure is adapted for retention of an adjustable fin; said fin provided with a fin-tab significantly shorter than said recess so as to enable said fin to move longitudinally between a first forward location and a second rearward location.

19. The structure of claim 18 wherein said adjustable fin is provided with recesses along sides of said fin-tab; said recesses adapted to engage with set-screws driven through said angled threaded holes.

20. A structure for releasable attachment of a fin to the body of a water board; said fin including fin-tab associated therewith; said structure adapted for insertion into and retention within said water board; said structure further adapted for reception and releasable retention of a plurality of fin-tab configurations thereby to releasably retain said fin in fixed relationship to said water board, said structure comprising:

a generally elongate body provided with a substantially rectangular section recess open at a first surface of said body; said recess extending to a base proximal to a second surface opposite said first surface, and said recess having a forward end and a rearward end;

wherein said structure is provided with a plurality of angled threaded holes extending from said first surface of said body to emerge at points within said recess approximately half way between said first surface and said base of said recess.

21. The structure of claim 20 wherein said structure is further provided with a vertical threaded hole extending from said first surface.

22. The structure of claim 20 wherein a first said angled threaded hole emerges at a forward end surface of said recess approximately half way between said first surface and said base of said recess.

23. The structure of claim 20 wherein in said first form of said structure further said angled threaded holes are disposed one on each side of said recess; a first one of said angled threaded holes coincident with a forward one of said buttress portions and a second one of said angled threaded holes coincident with a rearward one of said buttress portions.

24. The structure of claim 20 wherein said structures of said second form and third form, further said angled threaded holes are provided as a pair of angled threaded holes arranged along a side of said recess nearest said center fin and coincident with said buttress portions.

25. The structure of claim 20 wherein said angled threaded holes are adapted to receive therein set-screws provided with hexagonal drive sockets.

26. The structure of claim 25 wherein any one of said plurality of fin-tab configurations is retained in said recess by engagement of said fin-tab by at least one of said set-screws.

27. The structure of claim 25 wherein at least one fin-tab of said plurality of fin-tab configurations is retained in said recess by said fixed retention member and at least one of said set-screws.

28. A method for releasable attachment of a plurality of fin-tab configurations of at least one fin of a water board; said method including the steps of:

(a) providing at least a fin box embedded in said water board; said fin box comprising an elongate body with a recess, (b) withdrawing set-screws provided in angled threaded holes in said fin box sufficient to allow insertion of said fin-tab into said recess, (c) inserting an insert into the recess, wherein said insert is adapted to receive a first type of said fin-tab and position the fin-tab within the recess;

(d) driving said set-screws into contact with the first type of said fin-tab while said first type of said fin-tab is seated in the insert and in the recess.

29. The method of claim 28 wherein said at least one fin includes a center fin and left and right fins of a three-fin system.

30. The method of claim 28 wherein said fin-tab configurations include fin-tabs in line with a median plane of said fin and fin-tabs set at an angle to said median plane.

31. The method of claim 28 wherein said plurality of fin-tab configurations includes a fin-tab comprising an upwardly projecting blade portion extending for a portion of a leading end of said fin; said blade portion provided with pairs of laterally projecting vertical elements on either side of said blade portion; said fin-tab further including a horizontal cylindrical portion generally disposed between said laterally projecting vertical elements and wherein at least one of said set-screws engages with said cylindrical portion.

32. The method of claim 28 wherein said plurality of fin-tab configurations includes a fin-tab comprising two upwardly projecting blade portions; said blade portions nested in an insert adapted for insertion into said recess such that said set-screws engage with said blade portions and with said insert.

33. The method of claim 28 wherein said plurality of fin-tab configurations includes a fin-tab extending substantially the length of said fin; said fin-tab provided with a rear notch adapted for engagement with a retaining member disposed at a rearward end of said recess; said fin-tab further provided with a forward notch; said forward notch adapted for engagement with one of said set-screws.

34. The method of claim 28 wherein said plurality of fin-tab configurations includes a fin-tab provided with an elongate slot disposed at an interface between said fin-tab and said fin.

35. The method of claim 28 wherein said plurality of fin-tab configurations includes a fin-tab of an adjustable fin; said fin-tab slidably adjustable between a first forward position and a second rearward position in said recess.

36. The method of claim 35 wherein said fin-tab of said adjustable fin is significantly shorter than said fin; said fin-tab provided with recesses along at least one side of said fin-tab for engagement with two of said set-screws.

37. The method of claim 35 wherein the difference between lengths of said fin-tab and said fin is in the range of 15 to 25 mm.

38. A fin box assembly for releasable attachment of a fin to the body of a water board; said fin including a fin-tab associated therewith; said fin box adapted for insertion into and retention within said water board, wherein said fin box assembly comprising:

a generally elongate body for placement in a slot in an underside surface of the water board, said body including a substantially rectangular section recess open at a first surface of said body adapted to be substantially coplanar with the underside of the water board; said recess extending to a base proximal to a second surface opposite said first surface, and said recess having a forward end and a rearward end;

a removable retention mechanism to be positioned within the body that engages with a first configuration of fin tabs, and a fixed retention mechanism to be positioned within the body that engages with a second configuration of fin tabs;

wherein said fin box assembly is adapted for reception and releasable retention of a plurality of fin-tab configurations thereby to releasably retain said fin in fixed relationship to said water board; and wherein a first surface of said fin box is of a length and a width sufficient to support said fin entirely so that no portion of said fin is in contact with the body of said water board.

39. The fin box of claim 38 wherein each said fin box comprises a generally elongate body provided with a substantially rectangular section recess open at said first surface; said recess extending to a base proximal to a second surface opposite said first surface; said recess having a forward end and a rearward end.

40. The fin box of claim 39 wherein said fin box is provided with a peripheral flange extending outwardly from said body at said first surface; a first portion of said flange defining an area of said first surface around said recess; an outer area of said flange offset from said first surface; said offset arranged so that when said outer area of said flange is flush with a surface of the foam core of a water board, said first surface is substantially flush with a finished exterior surface of said water board.

41. The fin box of claim 40 wherein sidewalls of said recess of said fin box are parallel one to another and vertical relative said first surface.

42. The fin box of claim 39 wherein said fin box is provided with a peripheral flange extending outwardly from said body at said first surface; a first portion of said flange defining an area of said first surface around said recess; an outer area of said flange offset from said first surface; said offset arranged so that when said outer area of said flange is flush with a surface of the foam core of a water board, said first surface is substantially flush with a finished exterior surface of said water board, wherein each said right hand fin box, said center fin box and said left hand fin box is provided with a removable insert said insert extending substantially the length, depth and width of said recess.

43. The fin box of claim 42 wherein each said removable insert is provided with a notch at a rearward end of said insert; said notch adapted for engagement with a transverse insert retaining structure at said rearward end of said recess.

44. The fin box of claim 42 wherein each said removable insert is provided with two receiving recesses; said two receiving recesses sized in length and disposed along the length of said removable insert, to conform with length and disposition of said two outwardly sloping wall sections.

45. The fin box of claim 44 wherein for said right hand fin box and said left hand fin box, a wall of each of said receiving recesses opposite said outwardly sloping wall sections, is parallel to said outwardly sloping wall section when said removable insert is located in said recess.

46. The fin box of claim 44 wherein for said center fin box a wall of each of said receiving recesses is parallel to an opposite wall of said recess in said center fin box when said insert is located in said recess.

47. The fin box of claim 44 wherein said receiving recesses of said removable insert are provided with a slot through said wall of said receiving recesses adjacent a sidewall of said recess of said fin box; said slot aligned with a said angled threaded hole so as to allow a said set screw to pass through said slot.

48. The fin box of claim 42 wherein for each combination of fin box recess and removable insert the cross section and depth of slots formed by said receiving recesses and said opposite walls of said fin box recess conform to cross section and length of said dual fin-tabs.

49. A fin box for releasable attachment of a fin to the body of a water board; said fin including a fin-tab associated therewith; said fin box adapted for insertion into and retention within said water board; said fin box further adapted for reception and releasable retention of a plurality of fin-tab configurations thereby to releasably retain said fin in fixed relationship to said water board; and wherein a first surface of said fin box is of a length and a width sufficient to support said fin entirely so that no portion of said fin is in contact with the body of said water board, and wherein various ones of said fin box are adapted as a center fin box for retaining a fin in the center of said water board, a right hand fin box for retaining a fin at a right hand side of said water board, and a left hand fin box for retaining a fin at a left hand side of water board.

50. The fin box of claim 49 wherein at least one of said sidewalls of said recess of each of said right hand fin box and said left hand fin box is provided with at least one outwardly sloping wall section; said outwardly sloping wall section of said right hand fin box disposed along the right hand side of said recess; said outwardly sloping wall section of said left hand fin box disposed along the left hand side of said recess.

51. The fin box of claim 50 wherein said right hand fin box and said left hand fin box—are each provided with two said outwardly sloping wall sections disposed along respective said right hand side of said recess of said right hand fin box and said left hand side of said left hand fin box.

52. The fin box of claim 51 wherein said two said outwardly sloping wall sections conform in length and disposition to respective length and disposition of dual fin tabs of at least one of said plurality of fin-tab configurations.

53. The fin box of claim 50 wherein each of said left hand fin box and said right hand fin box is provided with at least two angled threaded holes passing from said first surface to a said sidewall of said recess opposite said outwardly sloping wall sections.

54. The fin box of claim 53 wherein each of said angled threaded holes is adapted to accept a set screw therein; said set screw arranged to lock in position a fin-tab of a fin installed in a said fin box.

55. The fin box of claim 49 wherein said center fin box is provided with two angled threaded holes; a first of said angled threaded holes passing from said first surface to a first sidewall of said recess and a second of said angled threaded holes passing from said first surface to a second opposite said sidewall of said recess.

56. The fin box of claim 46 wherein each of said right hand fin box and said left hand fin box is provided with a pair of said threaded angled holes; said pair located at a side of said recess opposite to respective said right hand side and said left hand side of water board.

57. The fin box of claim 49 wherein said center fin box is provided with a pair of said angled threaded holes; one of said pair located on a right hand side of said recess and another of said pair located at a left hand side of said recess.

58. The fin box of claim 49 wherein spacing between said pair of angled threaded holes of each of said center, right hand and left hand fin box conforms to spacing between centers of said dual fin-tabs.

59. The fin box of claim 49 wherein parallel opposing sidewalls of said recess of each of said right hand fin box and said left hand fin box slope outwardly; said sidewalls of said right hand fin box sloping towards a right hand side of said water board; said sidewalls of said left hand fin box sloping to a left hand side of said water board.

60. The fin box of claim 59 wherein length and depth of said recess conforms to overall length and depth of dual fin-tabs of one of said plurality of fin-tab configurations; said overall length defined by a leading edge of a front fin-tab and a trailing edge of a rearward fin-tab of said dual fin-tabs.

61. The fin box of claim 59 wherein said recess is of a length greater than the overall length of dual fin-tabs of one of said plurality of fin-tab configurations; said length of said recess providing for fore and aft adjustment of a fin mounted in said fin box.

62. The fin box of claim 59 wherein said recess is of a length greater than the length of a one-piece fin-tab of one of said plurality of fin-tab configurations; said length providing fore and aft adjustment of a fin mounted in said fin box.

63. The fin box of claim 59 wherein fin-tabs located in said fin box are releasably locked therein by means of set screws driven through at least two angled threaded holes into engagement with sidewalls of said fin-tabs.

64. A fin retention system adapted to be positioned within a water craft, the system comprising:

a fin box body that defines an opening wherein the opening is sized so as to receive a plurality of different types of fins, each of the plurality of different type of fins having fin tabs having different configurations wherein the body is adapted to be mounted through an outer surface of the water craft;

a flange that surrounds the opening in the body so as to extend outward therefrom wherein the flange is positioned generally flush with the outer surface of the water craft when the body is positioned within the water craft;

a first retention mechanism positioned within the body that engages with a first configuration of fin tabs; and a second retention mechanism positioned within the body that engages with a second configuration of fin tabs.

65. A fin box for a water board, said fin box comprising:

a generally elongate body provided with a substantially rectangular section recess open at a first surface of said body;

a peripheral flange extending outwardly from said elongate body at said first surface, a first portion of said peripheral flange defining an area of said first surface around said recess;

an outer area of said peripheral flange offset from said first surface, said outer area arranged so that when said outer area of said flange is flush with a surface of a foam core of a said water board the first surface is substantially flush with a finished exterior surface of said water board;

a pair of buttress portions along at least one side of said elongate body, the buttress portions forming a projecting abutment between a surface of said flange opposite said first surface and said at least one side of said elongate body, and wherein at least one pair of angled threaded holes extend from said first surface of said elongate body to emerge at points within said recess approximately half way between said first surface and a base of said recess, said angled threaded holes disposed along at least one side of said recess and each hole of said angled threaded holes coincident with a said buttress portion.

66. The fin box of claim 65 adapted to form at least one of: a right hand fin box for retaining a fin at a right hand side of said water board and a left hand fin box for retaining a fin at a left hand side of said water board, and wherein at least one side wall of said recess of each of said fin box is provided with at least a portion of an outwardly sloping wall section.

67. The fin box of claim 65 wherein said recess has a length at least as long as an overall length of dual fin-tabs of one of said plurality of fin-tab configurations, wherein said overall length defined by a leading edge of a front fin-tab and a trailing edge of a rearward fin-tab of said dual fin-tabs.

68. The fin box of claim 67 wherein the recess length is substantially greater than said overall length to provide for fore and aft adjustment of a said fin mounted in said recess of the fin box.

69. The fin box of claim 65 wherein said area of said first surface of said fin box is of a length and width sufficient to support said fin entirely so that no portion of said fin is in contact with said body of said water board.

70. The fin box of claim 65 wherein said outer portion of said peripheral flange is provided with a plurality of apertures distributed at intervals around said recess; said apertures adapted to allow passage therethrough of resin or bonding agent.

71. A fin box for a water board, said fin box comprising:

a generally elongate body provided with a substantially elongated recess open at a first surface of said body;

a peripheral flange extending outwardly from said elongate body at said first surface;

a buttress along at least one side of said elongate body, the buttress portions forming a projecting abutment between a said flange opposite and said at least one side of said elongate body;

an angled hole extending through the flange, the buttress and through said at least one side of said elongate body, and a shaft seated in the angled hole and adapted to abut a side of a fin inserted in the recess of the fin box, wherein the shaft secures the fin to the fin box and water board when seated in the angled hole and abutting the fin.

72. A fin box as in claim 71 wherein the peripheral flange is substantially orthogonal to the recess in the fin box and the buttress is a triangular section substantially orthogonal to the recess and the flange.

73. A fin box as in claim 71 wherein the peripheral flange is at least partially recessed below a finished bottom surface of the water board when the fin box is mounted in the water board.

74. A fin box as in claim 71 wherein the angled hole has threads to receive threads on the shaft.

75. A fin box as in claim 71 wherein the buttress is at least a pair of buttresses and the angled hole is a hole in each of the buttresses.

76. A fin box as in claim 71 further comprising a removable insert having an outer shape adapted to fit snugly in the recess and having a receiving surface adapted to receive a first type of fin, wherein the insert further comprises an opening which is aligned with the angled hole when the insert is in the recess to allow the shaft to abut against the first type of fin.

* * * * *

UNITED STATES PATENT AND TRADEMARK OFFICE

CERTIFICATE OF CORRECTION

PATENT NO. : 7,198,532 B2
APPLICATION NO. : 11/300642
DATED : April 3, 2007
INVENTOR(S) : John Field It is certified that error appears in the above-identified patent and that said Letters Patent is hereby corrected as shown below:

Claim 9, column 10, line 10:

After “approximately” insert --5--.

Signed and Sealed this

Seventeenth Day of July, 2007

JON W. DUDAS
*Director of the United States Patent and Trademark Office*